US009249536B2

(12) United States Patent
Kim

(10) Patent No.: US 9,249,536 B2
(45) Date of Patent: Feb. 2, 2016

(54) WASHING MACHINE AND METHOD FOR CONTROLLING THE SAME

(71) Applicant: SAMSUNG ELECTRONICS CO., LTD., Suwon (KR)

(72) Inventor: Yeon Woo Kim, Suwon (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/753,204

(22) Filed: Jun. 29, 2015

(65) Prior Publication Data

US 2015/0299927 A1 Oct. 22, 2015

Related U.S. Application Data

(63) Continuation of application No. PCT/KR2015/001107, filed on Feb. 3, 2015.

(30) Foreign Application Priority Data

Mar. 7, 2014 (KR) ..... 10-2014-0026898
Mar. 7, 2014 (KR) ..... 10-2014-0027340
Jan. 13, 2015 (KR) ..... 10-2015-0006041

(51) Int. Cl.
*D06F 33/00* (2006.01)
*D06F 33/02* (2006.01)
(Continued)

(52) U.S. Cl.
CPC ..... *D06F 33/02* (2013.01); *D06F 29/00* (2013.01); *D06F 37/28* (2013.01); *D06F 37/42* (2013.01); *D06F 39/003* (2013.01); *D06F 39/004* (2013.01); *D06F 39/005* (2013.01); *D06F 39/04* (2013.01); *D06F 39/045* (2013.01);
(Continued)

(58) Field of Classification Search
CPC ..... D06F 29/00; D06F 31/00; D06F 39/14; D06F 45/12; D06F 45/14; D06F 87/00
See application file for complete search history.

(56) References Cited

U.S. PATENT DOCUMENTS 3,026,699 A * 3/1962 Rhodes ..... D06F 29/00 68/12.19
5,048,139 A * 9/1991 Matsumi ..... D06F 39/004 68/12.02

(Continued)

FOREIGN PATENT DOCUMENTS

JP 58-8484 1/1983
JP 7-20186 4/1995

(Continued)

OTHER PUBLICATIONS

Korean Office Action issued May 13, 2015 in related Korean Patent Application No. 10-2015-0046449.

(Continued)

*Primary Examiner* — David Cormier
(74) *Attorney, Agent, or Firm* — Staas & Halsey LLP

(57) ABSTRACT

The disclosure provides a washing machine and method for controlling the same. An embodiment of the washing machine includes an auxiliary washing unit placed below a door arranged on top of a main body; an input unit for receiving instructions to start and stop auxiliary washing; and a water supply unit for supplying water to the auxiliary washing unit if the instruction to start water supply is input, and stopping supplying water to the auxiliary washing unit if the instruction to stop water supply is input.

18 Claims, 32 Drawing Sheets

(51) Int. Cl.

| | |
|---|---|
| ***D06F 29/00*** | (2006.01) |
| ***D06F 39/14*** | (2006.01) |
| ***D06F 39/00*** | (2006.01) |
| ***D06F 39/08*** | (2006.01) |
| ***D06F 37/28*** | (2006.01) |
| ***D06F 37/42*** | (2006.01) |
| ***D06F 39/04*** | (2006.01) |

(52) U.S. Cl.

CPC ..... *D06F 39/08* (2013.01); *D06F 39/083* (2013.01); *D06F 39/087* (2013.01); *D06F 39/088* (2013.01); *D06F 39/14* (2013.01); *D06F 2202/04* (2013.01); *D06F 2202/08* (2013.01); *D06F 2202/085* (2013.01); *D06F 2202/12* (2013.01); *D06F 2204/04* (2013.01); *D06F 2204/084* (2013.01); *D06F 2204/086* (2013.01); *D06F 2210/00* (2013.01); *D06F 2216/00* (2013.01)

(56) References Cited

U.S. PATENT DOCUMENTS 5,868,311 A * 2/1999 Cretu-Petra ..... E03C 1/057 236/12.12

7,313,932 B2 * 1/2008 Ryohke ..... D06F 19/00 68/13 R

2003/0213850 A1 * 11/2003 Mayer ..... G05D 23/1393 236/12.12

FOREIGN PATENT DOCUMENTS

| | | |
|---|---|---|
| KR | 1995-0025138 | 9/1995 |
| KR | 1997-0001664 | 1/1997 |
| KR | 1997-0015854 | 4/1997 |
| KR | 1999-0075790 | 10/1999 |
| KR | 2000-0045026 | 7/2000 |
| KR | 10-2001-0020106 | 3/2001 |
| KR | 2002-0008454 | 1/2002 |
| KR | 2003-0044491 | 6/2003 |
| KR | 2003-0060572 | 7/2003 |
| KR | 10-2005-0037059 | 4/2005 |
| KR | 10-2010-0068882 | 6/2010 |

OTHER PUBLICATIONS

Korean Notice of Allowance issued Jul. 28, 2015 in related Korean Patent Application No. 10-2015-0046449.

International Search Report issued May 13, 2015 in corresponding International Patent Application No. PCT/KR2015/001107.

U.S. Appl. No. 14/794,031, filed Jul. 8, 2015, Yeon Woo Kim, Samsung Electronics Co., Ltd.

* cited by examiner

WASHING MACHINE AND METHOD FOR CONTROLLING THE SAME

CROSS-REFERENCE TO RELATED APPLICATIONS

This application is a continuation of International Application PCT/KR2015/001107 filed Feb. 3, 2015, and claims foreign priority to Korean application 10-2014-0026898 filed Mar. 7, 2014, Korean application 10-2014-0027340 filed Mar. 7, 2014, and Korean application 10-2015-0006041 filed Jan. 13, 2015, the disclosures of which are incorporated herein by reference in their entireties.

BACKGROUND

1. Field

Embodiments of the disclosure relate to a washing machine and method for controlling the same, in which water supply of an auxiliary washing unit for allowing a user to perform washing by hand is controlled independently of main washing.

2. Description of the Related Art

Generally, a washing machine (e.g., a fully automatic washing machine) is a machine that removes contamination from laundry through a water movement and surface activity of detergent, and includes an outer tub for storing water (water for cleaning or for rinsing), an inner tub rotatably installed within the outer tub to accommodate laundry, a pulsator rotatably installed within the inner tub to produce a water movement, and a driving unit for producing a driving force to rotate the inner tub and the pulsator.

A washing machine washes laundry through sequential cycles including a washing cycle of separating contamination from the laundry with water in which detergent is dissolved (i.e., washing water), a rinsing cycle of rinsing off bubbles or remaining detergent with detergent-free water (i.e., rinsing water), and a spin-drying cycle of dewatering the laundry with high-speed rotation.

Although some types of laundry can be washed through main washing including the washing, rinsing, and spin-drying cycles, other types of laundry, such as socks, white clothes, and undergarments with dirt require washing by hand, and other types of laundry may be washed by hand according to a user's preference.

Such washing by hand is usually performed outside of the washing machine, and thus there is a need for users to be able to perform washing by hand in a space around the washing machine for the purposes of water saving, user convenience, etc.

SUMMARY

The disclosure provides a washing machine and method for controlling the same, in which states for washing by hand are sensed and timings at which water supply to an auxiliary washing unit is started and stopped are controlled based on sensed states for washing by hand.

The disclosure also provides a washing machine and method for controlling the same, in which it is determined whether to drain washing water used in washing by hand or whether to reuse the washing water for main washing based on user instructions.

In accordance with an aspect of the disclosure, a washing machine is provided. The washing machine includes, for example, an auxiliary washing unit placed between a door and an opening, an input unit for receiving instructions to start and finish auxiliary washing, a water supply unit for supplying water to the auxiliary washing unit, and a control unit for controlling the water supply unit to supply water to the auxiliary washing unit when the instruction to start auxiliary washing is received and controlling the water supply unit to stop supplying water to the auxiliary washing unit when the instruction to finish auxiliary washing is received.

The washing machine may further include a sensing unit for sensing whether the door is open or closed, measuring a water level inside an outer tube, measuring a water supply time duration, and measuring a distance to a user.

The control unit may control the water supply unit to supply water when the door or the auxiliary washing unit is open.

The control unit may control the water supply unit to stop supplying water when the door is closed, the water level inside the outer tube is equal to or greater than a predetermined water level, the water supply time duration is equal to or greater than a predetermined time limit, or the distance to a user is equal to or greater than a predetermined distance.

The washing machine may supply water for a second predetermined time when an input time duration for receiving the instruction to start auxiliary washing through the input unit exceeds a first predetermined time and supply water for the input time duration when the input time duration does not exceed the first predetermined time.

The washing machine may clean the auxiliary washing unit when an instruction to clean the auxiliary washing unit is received and may allow the display unit to inform a user of the termination of water supply when the water supply unit stops supplying water.

In accordance with another aspect of the disclosure, a washing machine is provided. The washing machine includes, for example, a main body having an opening, a door for opening or closing the opening, an auxiliary washing unit mounted below the door to be pivotable about one side, an outer tub mounted inside the main body for containing washing water, a drainage unit for draining the washing water contained in the outer tube, an input unit for receiving an instruction for drainage to drain the washing water, and a control unit for controlling the drainage unit to drain the washing water in response to the instruction for drainage.

The control unit may control the drainage unit not to drain the washing water when the instruction for drainage is not received.

The washing machine may further include a water level sensing unit for measuring a water level of washing water contained in the outer tub.

The control unit may control the drainage unit to drain the washing water when the water level of the washing water measured by the water level sensing unit is equal to or greater than a predetermined water level.

The washing machine may further include a turbidity sensing unit for measuring turbidity of washing water contained in the outer tub.

The control unit may control the drainage unit to drain the washing water when the turbidity of the washing water measured by the turbidity sensing unit is equal to or greater than a predetermined level.

The input unit may receive the instruction for drainage that includes a desired amount of washing water to be kept in the outer tub.

The control unit may control the drainage unit to drain rest washing water except for the desired amount of washing water to be kept in the outer tub.

The input unit may be inactivated while the drainage unit is draining the washing water.

The washing machine may further include an display unit for informing that the washing water is being drained.

The drainage unit may include a drainage valve for controlling drainage of the washing water, and the control unit may control the drainage valve to drain the washing water when the instruction for drainage is received.

The drainage unit may include a drainage pump for applying a pressure to force the washing water to be drained, and the control unit may drive the drainage pump when the instruction for drainage is received.

In accordance with another aspect of the disclosure, a method for controlling a washing machine is provided. The method includes, for example, detecting an instruction to start auxiliary washing, supplying water to an auxiliary washing unit when the instruction to start auxiliary washing is detected, detecting an instruction to finish auxiliary washing, and stopping supplying water to the auxiliary washing unit when the instruction to finish auxiliary washing is detected.

In accordance with another aspect of the disclosure, a method for controlling a washing machine that includes, for example, an auxiliary washing unit mounted below a door to have an auxiliary washing space for washing by hand and be pivotable about one side and a water supply unit for supplying washing water to the auxiliary washing unit, is provided. The method includes, for example, supplying washing water to the auxiliary washing unit from the water supply unit, determining whether an instruction for drainage is received to drain the washing water discharged into an outer tub of the washing machine from an auxiliary drain of the auxiliary washing unit, and draining the washing water from the outer tub when the instruction for drainage is received.

According to an embodiment of the washing machine and method for controlling the same, water supply to an auxiliary washing unit may be controlled based on results of detecting an instruction signal, a door position, and water-supply conditions.

According to another embodiment of the washing machine and method for controlling the same, washing water may be saved by determining whether to reuse the washing water used in washing by hand based on user instructions.

According to yet another embodiment of the washing machine and method for controlling the same, whether to reuse washing water used in washing by hand may be efficiently determined based on results of measuring water turbidity or a water level of the washing water.

DETAILED DESCRIPTION

The following description with reference to the accompanying drawings is provided to allow a person of ordinary skill in the art to have a comprehensive understanding of the embodiment of the disclosure. Descriptions of some well-known technologies that may obscure the embodiments of the disclosure will be omitted as necessary.

The terms as used herein are defined in view of functionality as it pertains to the embodiments, but may vary depending on certain practices or intentions of users (U) or operators. Thus, terms that are specifically defined in the specification should be understood with the meaning thus defined, and otherwise, if there is no specific definition for a term, the term should be interpreted according to its common meaning understood by one of ordinary skill in the related art Furthermore, aspects and configurations of the embodiments selectively written in this specification should be understood to be freely combinable with one another unless otherwise defined or technically incompatible.

Embodiments of a washing machine and method for controlling the same will now be described with reference to accompanying drawings.

An embodiment of a washing machine will be described with reference to FIGS. 1 and 2.

Figure 1:
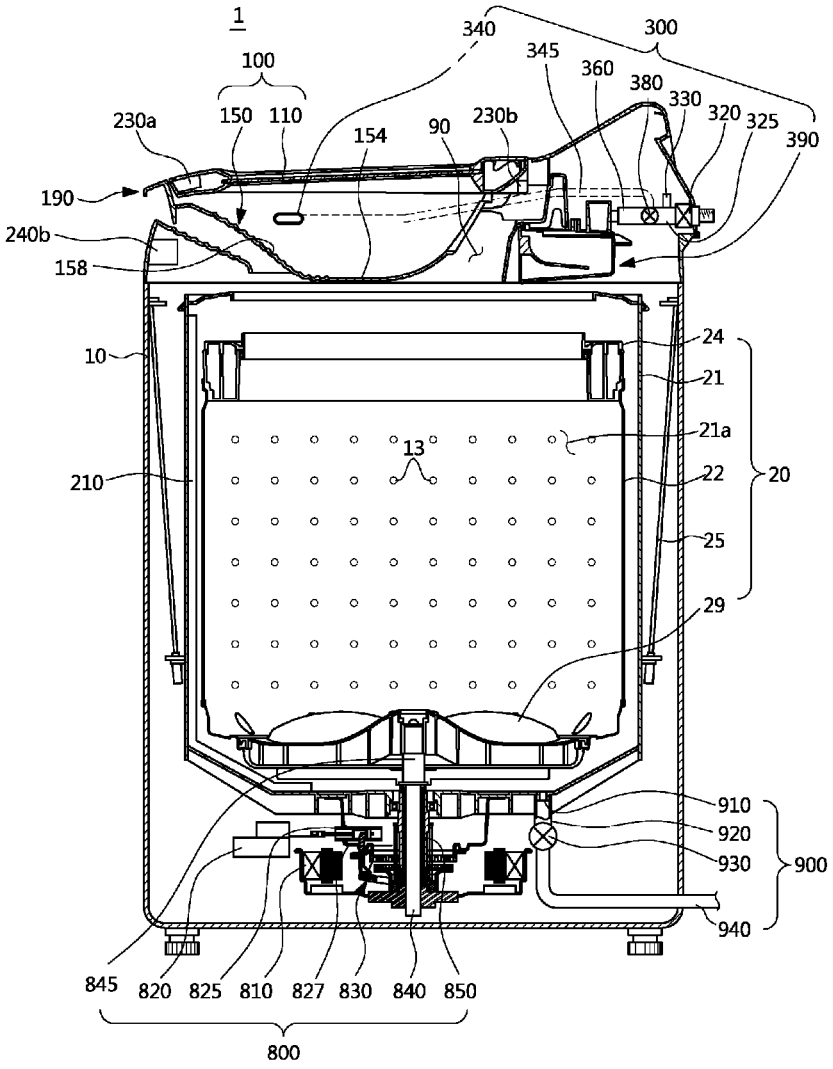
FIG. 1 is a cross-sectional view of a washing machine according to an embodiment of the disclosure.

FIG. 1 shows the exterior of a washing machine. Also, FIG. 2 is a block diagram of a washing machine.

Figure 2:
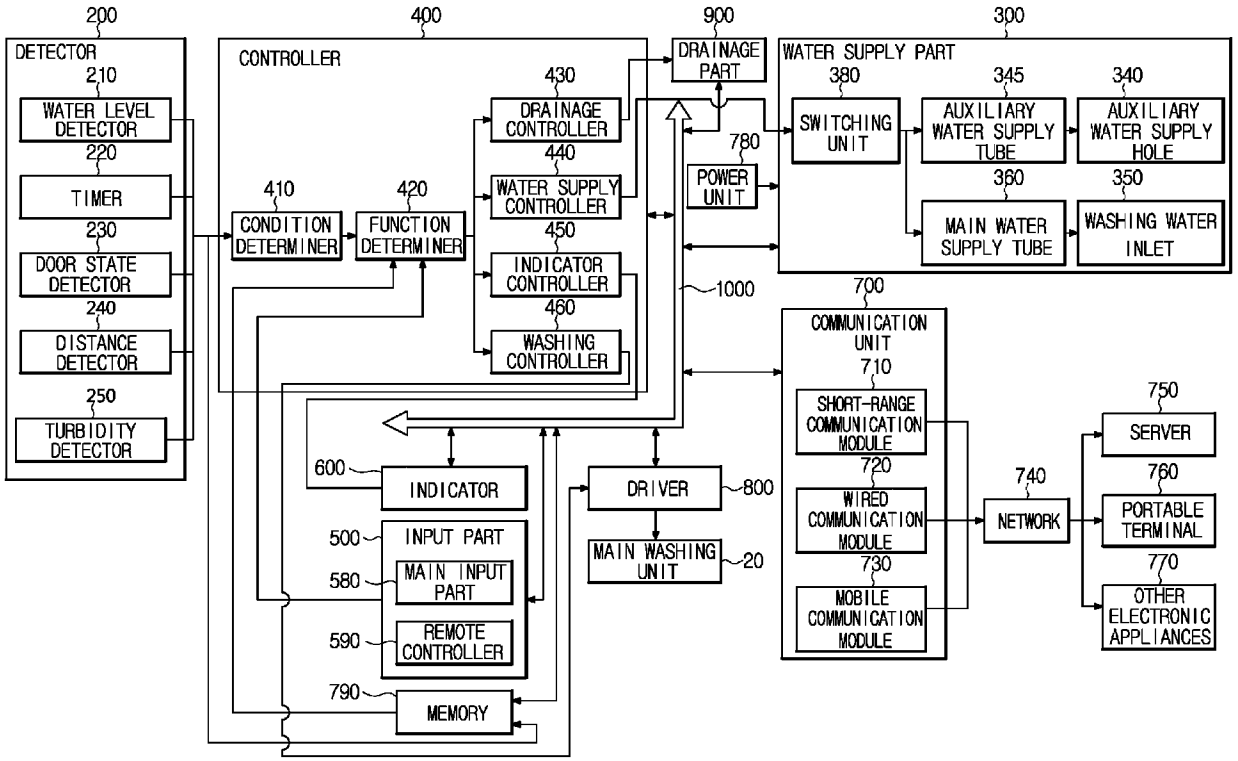
FIG. 2 is a block diagram of a washing machine according to an embodiment of the disclosure.

As shown in FIGS. 1 and 2, a washing machine 1 may include a main body 10 that forms the exterior, a main washing unit 20 for performing main washing, a door assembly 100 that prevents overflowing of washing water during the main washing and enables auxiliary washing, a water supply unit 300 for supplying washing water or detergent, a sensing unit 200 for sensing an operating state or operating conditions of the washing machine 1, a driving unit 800 for producing a driving force required for washing, and a drainage unit 900 for draining water.

An opening 90 through which laundry can be put into an inner tub 22 may be formed on the top of the main body 10. The opening 90 may be opened and closed by the door assembly 100 installed on top of the main body 10. An outer tub 21 may be supported in the main body 10 by a suspension device 25.

The main washing unit 20 is a device for performing main washing and may include the outer tub 21, the inner tub 22, a balancer 24, a pulsator 29, and the suspension device 25.

The outer tub 21 may be formed in a cylindrical shape with the top open around the outside of the inner tub 22 and may assist the inner tub 22 with the washing cycle using washing water and detergent stored therein.

The inner tub 22 may be formed in a cylindrical shape with the top open and laundry is stored therein. A plurality of spin-drying holes 13 that bring the inner space of the inner tub 22 in communication with the inner space of the outer tub 21 may be formed on the side wall of the inner tub 22.

The balancer 24 may be mounted on the top of the inner tub 22 and serves to offset unbalanced weight in the inner tub 22 that occurs during high-speed rotation such that the inner tub 22 can rotate stably.

The pulsator 29 may be mounted on the bottom of the inner tub 22 to produce a water movement by rotating clockwise or counter-clockwise, and the water movement may agitate the laundry and water in the inner tub 22.

The door assembly 100 may prevent the water stored in the outer tub 21 or washing water supplied from the water supply unit 300 from overflowing outside during the main washing cycles and may provide an auxiliary washing space 150*a* for washing by hand.

The door assembly 100 may include a door 110 and an auxiliary washing unit 150.

The door assembly 100 will be described later in more detail in connection with FIGS. 3 to 8.

The water supply unit 300 is a device for supplying washing water with detergent required for washing.

Specifically, a water supply tube 325 may be installed over the outer tub 21 to supply washing water to the outer tub 21. One end of the water supply tube 325 may be connected to an external water supply source and the other end of the water supply tube 325 may be connected to a detergent supply device 390. Water supplied through the water supply tube 325 is supplied into the outer tub 21 via the detergent supply device 390 in addition to detergent. A water supply valve 320 may be installed in the water supply tube 325 to control water supply.

The water supply unit 300 may include the water supply tube 325, a main water supply tube 360, an auxiliary water supply tube 345, a switching unit 380, an auxiliary water supply outlet 340, a washing water inlet 350, and a water temperature control unit 330.

The water supply tube 325 may be connected to the water supply valve 320 at one end, and to the switching unit 380 at the other end. The water supply tube 325 is configured to deliver washing water supplied from the water supply valve 320 to the switching unit 380.

The main water supply tube 360 may be configured to supply water into a main washing space 21*a*. The main water supply tube 360 may be connected to the detergent supply device 390 at one end, and to the switching unit 380 at the other end.

The auxiliary water supply tube 345 is configured to supply water into the auxiliary washing space 150*a* of the auxiliary washing unit 150. The auxiliary water supply tube 345 may be connected to the auxiliary water supply outlet 340 at one end, and to the switching unit 380 at the other end.

The switching unit 380 may be configured to distribute washing water delivered from the water supply tube 325 selectively to one of the main water supply tube 360 and the auxiliary water supply tube 345. Specifically, washing water may be supplied into the washing space through at least one of the main water supply tube 360 and the auxiliary water supply tube 345 by controlling the switching unit 380. Furthermore, the switching unit 380 may include a three-way valve.

The main water supply tube 360 and the auxiliary water supply tube 345 may be branched from the water supply tube 325 via the switching unit 380. Alternatively, the main water supply tube 360 and the auxiliary water supply tube 345 may be connected to the water supply valve 320 and washing water may be supplied by controlling the water supply valve 320. That is, the main water supply tube 360 connected to the detergent supply device 390 at one end and the auxiliary water supply tube 345 connected to the auxiliary water supply outlet 340 at one end may be connected to the water supply valve 320 at the other ends.

The detergent supply device 390 may be connected to the auxiliary water supply tube 345 for the user to mix washing water and detergent to be supplied to the auxiliary washing unit 150.

Washing water may be selectively supplied to one of the main water supply tube 360 and the auxiliary water supply tube 346 or supplied to both of them.

The auxiliary water supply outlet 340 may be connected to the auxiliary water supply tube 345. The auxiliary water supply outlet 340 may be disposed on one side of the auxiliary washing unit 150 to supply washing water to the auxiliary washing unit 150.

The washing water inlet 350 may be provided to correspond to the auxiliary washing unit 150 and the auxiliary water supply outlet 340 so that washing water supplied from the auxiliary water supply outlet 340 flows into the auxiliary washing unit 150. The washing water inlet 350 may be formed by an inlet edge 156*c* of a unit body 152 formed to be lower than an upper end 156*a* of the unit body 152.

In other words, the washing water inlet 350 may be formed to be recessed from the upper end 156*a* of the unit body 152.

The washing water inlet 350 is not limited to any particular shape but may have any shape that enables washing water to flow into the auxiliary washing space 150*a* through the auxiliary water supply outlet 340 without being interrupted by the unit body 152.

The water temperature control unit 330 controls the temperature of washing water supplied through the main water supply tube 360 or the auxiliary water supply tube 345. The water temperature control unit 330 may include a heat pump unit 331, a distribution unit 334, and a heated-water supply unit 337.

The water temperature control unit 330 will be described later in more detail in connection with FIG. 14.

The sensing unit 200 is a device for sensing an operating status or operating conditions of the washing machine 1.

Specifically, the sensing unit 200 may include a water level sensing unit 210 for measuring water stored in the outer tub 21, a timer 220 for measuring an auxiliary washing input time duration and an auxiliary water supply time duration, a door position sensing unit 230 for sensing whether the door 110 is open or closed, a distance sensing unit 240 for measuring a distance between a user and the washing machine 1, and a turbidity sensing unit 250 for measuring turbidity of washing water.

The water level sensing unit 210 may be mounted inside the outer tub 21 to measure a water level of the water stored in the outer tub 21. The water level sensing unit 210 may measure the water level of the water stored in the outer tub 21 through a mechanical water level measurement method, a measurement method by means of a semiconductor pressure sensor, a capacitance measurement method, or the like.

Specifically, the water level sensing unit 210 may include a water path into which the water stored in the outer tub 21 is introduced from the bottom of the outer tub 21, and the water level in the outer tub 21 may be equal to that of the water path. In this case, there may be internal air above the water in the water path of the water level sensing unit 210. The internal air pressure may be measured, and water level may be calculated based on the internal air pressure.

In the mechanical water level measurement method, as water comes into the outer tub 21 of the washing machine 1 and the water level rises, the internal air pressure between the surface of the water in the water path and the water level sensing unit 210 increases. In the mechanical water level sensing device, the rising air pressure forces up a diaphragm, which in turn pushes up a core. Due to an interaction between the core and a bobbin that encircles the core, there is a change in the magnetic flux density, and the changed magnetic flux density is resonant with a capacitance in the operation circuit and output as a frequency. The fact that the output frequency changes according to the magnetic flux density changed by the water level may be used to determine the water level in the outer tub 21.

In the measurement method by means of a semiconductor pressure sensor, the semiconductor pressure sensor includes a diaphragm with a strain gauge attached thereto. With the same principle as in the mechanical water level measurement method, the diaphragm is deformed by a change in air pressure, and the diaphragm deformation measured by the strain gauge may be used to determine the water level in the outer tub 21.

In the capacitance measurement method, the water level sensing unit 210 includes a plurality of water level sensors mounted upward on the inner wall of the outer tub 21, and the water level may be measured from a change in capacitance among a plurality of electrodes of the water level sensors.

Specifically, the dielectric of the plurality of electrodes is made up of air and water. Capacitance of the dielectric is changed by a ratio of the air and the water, and based on the changed capacitance, the water level in the outer tub 21 may be determined.

There may be various other methods for measuring the water level in the outer tub 21 by means of the water level sensing unit 210.

The timer 220 measures an input time duration for receiving an instruction through an input unit 500 to start water supply, and an auxiliary water supply time duration. The timer 220 may be a relay, e.g., a synchronized motor relay, a transistor relay, etc., which has a contact that turn on and off a circuit a predetermined time after reception of an input signal.

The door position sensing unit 230 is a device that senses whether the door 110 is open or closed, and provides a signal for use in auxiliary water supply control accordingly. The door position sensing unit 230 may include a reed switch 230*a* and a checker switch 230*b*.

The reed switch 230*a* may measure the intensity of a magnetic field of a magnet mounted on a handle unit 190 and sense whether the door 110 is open or closed based on the measured intensity of the magnetic field. Specifically, when the intensity of the magnetic field measured by the reed switch 230*a* is equal to or greater than a predetermined value, the door 110 is closed, and when the intensity of the magnetic field measured by the reed switch 230*a* is less than the predetermined value, the door 110 is open.

The checker switch 230*b* may include a body unit, and a door position sensing lever in contact with the door 110 for sensing an opening state of the door 110.

The body unit may be arranged on a door pivot shaft 114 and has a switch embedded therein. The switch is turned on or off by the door position sensing lever to generate a control signal. An electrode terminal connected to the switch for delivering the control signal produced from the switch to a control unit 400 may be installed on one side of the body unit.

The door position sensing lever may be installed to extend from a side of the body unit such that an end thereof comes in contact with one side of the door 110. The door position sensing lever turns the switch mounted on the body unit on or off by moving up or down when the door 110 is opened or closed.

The distance sensing unit 240 may be mounted on an upper part of the main body 10 to measure a distance between the user and the washing machine 1. For example, the distance sensing unit 240 may be mounted on left, right, and front surfaces of the washing machine 1 to measure distances between the user and the respective left, right, and front surfaces.

Specifically, the distance sensing unit 240 may measure a distance between the user and the washing machine 1 by measuring delay time or intensity of light reflected back from the user. Accordingly, the distance sensing unit 240 may include ultrasound sensors or infrared sensors. Various other sensors may be used to measure the distance between the user and the washing machine 1.

The turbidity sensing unit 250 may determine a contamination level of washing water by measuring turbidity of the washing water. The user may thus select whether washing water used for auxiliary washing is to be used for main washing based on the contamination level of the washing water.

The driving unit 800 is a device that generates a driving force and delivers it to the inner tub 22, the pulsator 29, etc., for main washing.

Specifically, there may be a motor 810 mounted on a lower exterior of the outer tub 21 to generate a driving force to rotate the inner tub 22 and the pulsator 29, and a power switching device 830 for delivering the driving force produced by the motor 810 to the inner tub 22 and the pulsator 29 simultaneously or selectively.

The inner tub 22 may be combined with a spin-drying shaft 850 with a hollow, and a washing shaft 840 installed in the hollow of the spin-drying shaft 850 may be combined with the pulsator 29 by means of a washing shaft coupler 845. The motor 810 may deliver a driving force to the inner tub 22 and the pulsator 29 simultaneously or selectively according to the ascending/descending operation of the power switching device 830.

The power switching device 830 may include an actuator 820 for producing a driving force for power transmission, a rod unit 825 that moves straight according to the operation of the actuator 820, and a clutch unit 827 connected the rod unit 825 to pivot with the movement of the rod unit 825.

The drainage unit 900 is a device for draining washing water from the outer tub 21.

Specifically, on the bottom of the outer tub 21, a drain 910 may be formed to drain the washing water contained in the outer tub 21, and the drain 910 may be connected to a first drainage tube 920. A drainage valve 930 may be installed in the first drainage tube 920 to control water drainage. The outlet of the drainage valve 930 may be connected to a second drainage tube 940 for draining the washing water to the outside.

The washing machine may include a power unit 780, a sensing unit 200, an input unit 500, a memory 790, a display unit 600, a water supply unit 300, a control unit 400, a driving unit 800, a main washing unit 20, a communication unit 700, and a drainage unit 900, all of which may be interconnected by a bus 1000.

The power unit 780 is a device for delivering external power source to the inside or for converting chemical energy to electric energy as in the battery and supplying the electric energy required for the operation of the washing machine 1.

The power unit 780 may also provide power to supply water or stop supplying water to the auxiliary washing unit 150 when the washing machine 1 has been turned off but left plugged in by the user.

The sensing unit 200 is a device for sensing an operating status and operating conditions of the washing machine 1 and may include a water level sensing unit 210, a timer 220, a door position sensing unit 230, a distance sensing unit 240, and a turbidity sensing unit 250.

The sensing unit 200 may be the same as the sensing unit 200 described above for the embodiment in FIG. 1.

The input unit 500 is a device for receiving a signal of an instruction to operate the washing machine 1 from the user and forwarding the instruction to the control unit 400. For example, the input unit 500 may forward an instruction to start water supply, an instruction to stop water supply, an instruction to clean the auxiliary unit, or an instruction to drain water to the control unit 400.

The input unit 500 may include a main input unit 580 and a remote controller 590.

Figure 4:
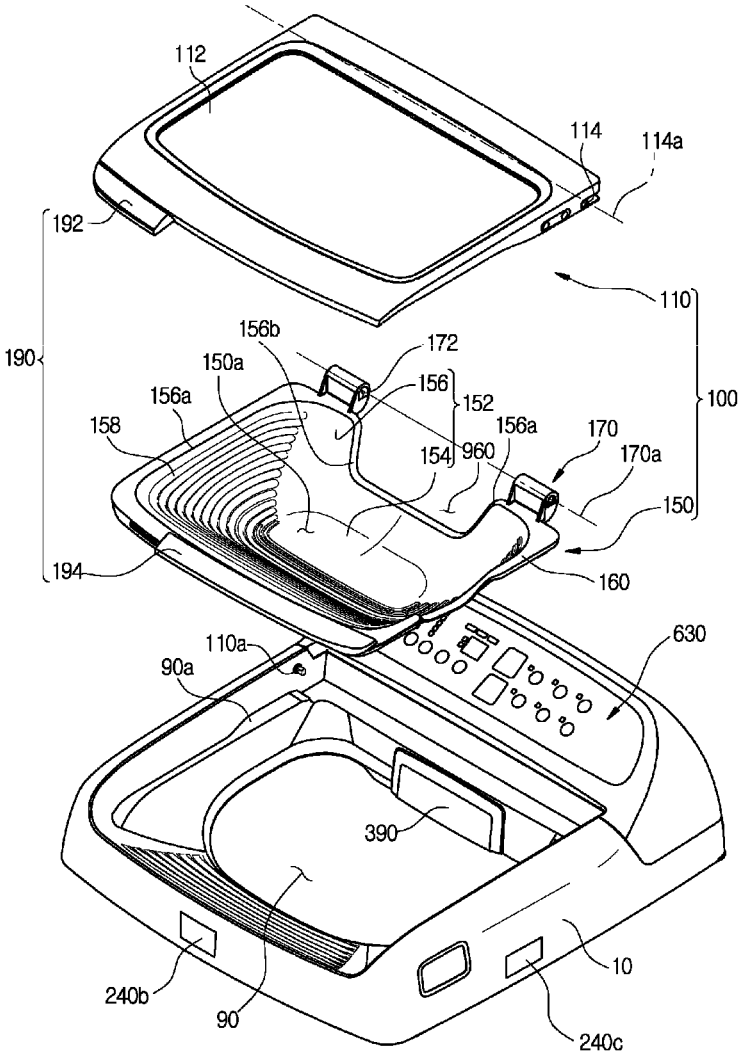
FIG. 4 is an exploded view of a door assembly of a washing machine according to an embodiment of the disclosure.

The main input unit 580 is a complex of many control buttons mounted on the top surface of the main body 10, as shown in FIG. 4, such that respective functions of the washing machine 1 can be selected. The main input unit 580 may be implemented with control buttons in the form of push buttons, or a slide switch or dial switch, or a touch pad for the user to select respective functions of the washing machine 1. Furthermore, it may be implemented with a touch screen which may be incorporated with the display unit 600 as will be described later. In addition, various other types of input devices may be used to select functions of the washing machine 1 in other embodiments of the main input unit 580.

The remote controller 590 is a separate device from the washing machine 1 for receiving user instructions to control operation of the washing machine 1 and forwarding the instructions to the washing machine 1 at or beyond a certain distance to the washing machine 1.

The memory 790 stores sensor data of the sensing unit 200, control data of the control unit 400, input data of the input unit 500, communication data of the communication unit 700, etc.

Based on the data stored in the memory 790, the control unit 400 may analyze a lifestyle pattern of the user by analyzing the user's use of the washing machine 1 and other electronic appliances 770, and store the result in the memory 790 to use it for control.

Specifically, based on the user's lifestyle pattern stored in the memory 790, the control unit 400 may determine a predetermined water level, a predetermined time limit, a first predetermined time, a second predetermined time, a predetermined distance, a predetermined number of washes, etc.

The display unit 600 may inform of a control condition of the washing machine 1 controlled by the control unit 400, an operation condition of the washing machine 1 sensed by the sensing unit 200, etc., for the user in a visible, audible, or tactile way.

For example, the display unit 600 may inform the user of termination of water supply when the control unit 400 stops supplying water to the auxiliary washing unit 150.

The water supply unit 300 may supply washing water or detergent to the auxiliary washing unit 150 and the main washing unit 20 under control of the control unit 400.

The water supply unit 300 may include a switching unit 380, an auxiliary water supply tube 345, an auxiliary water supply outlet 340, a main water supply tube 360, and a washing water inlet 350.

The water supply unit 300 may operate the switching unit 380 to supply water to the auxiliary washing unit 150 or the main washing unit 20 under control of the control unit 400.

Furthermore, when water is supplied into the auxiliary washing unit 150, the water supply unit 300 may supply washing water only or a mix of detergent and washing water to the auxiliary washing unit 150 for the user to perform washing by hand.

The water supply unit 300 may be the same as the aforementioned water supply unit 300 of FIG. 1, and the detailed description of the water supply unit 300 will be provided later in connection with FIG. 14.

The control unit 400 receives the signal of the sensing unit 200, the input signal of the input unit 500, the communication signal of the communication unit 700, or the data stored in the memory 790 and controls operation of the washing machine 1. The control unit 400 may include a condition determiner 410, a function determiner 420, a drainage control unit 430, a water supply control unit 440, an display control unit 450, and a washing control unit 460.

Specifically, the condition determiner 410 may determine a current washing condition by receiving a water level in the outer tub 21, an input time duration for receiving an instruction to start water supply, an auxiliary water supply time duration, whether the door 110 is opened or closed, a distance between the user and the washing machine 1 measured by the sensing unit 200, and an instruction to start water supply, an instruction to stop water supply, an instruction to clean the auxiliary washing unit 150, and an instruction to reuse washing water input by the user through the input unit 500.

The function determiner 420 may determine a function of the washing machine 1 to be subsequently performed based on the condition determined by the condition determiner 410 and the data stored in the memory 790.

For example, the function determiner 420 may determine a function to supply water to the auxiliary washing unit 150 when the instruction to start water supply is input or when the instruction to start water supply is input and the door 110 is open.

In another example, the function determiner 420 may determine a function to stop supplying water to the auxiliary washing unit 150 when the instruction to stop water supply is input, when the instruction to stop water supply is input and the door 110 is closed, when the instruction to stop water supply is input and the water level is equal to or greater than a predetermined level, when the instruction to stop water supply is input and the water supply time duration exceeds a predetermined time limit, or when the instruction to stop water supply is input and the distance between the user and the washing machine 1 is equal to or greater than a predetermined distance.

Furthermore, the function determiner 420 may determine a function of the water supply unit 300 supplying water for the second predetermined time when the input time duration for receiving an instruction to start water supply exceeds the first predetermined time, or supplying water for the input time duration for receiving the instruction to start water supply when the input time duration for receiving the instruction to start water supply does not exceed the first predetermined time.

Moreover, the function determiner 420 may determine a function to supply water to clean the auxiliary washing unit 150 before auxiliary water supply when the instruction to clean the auxiliary washing unit 150 is input. For example, the function determiner 420 may determine for the water supply unit 300 to supply water the predetermined number of times to clean the auxiliary washing unit 150 when the cleaning instruction is input.

The function determiner 420 may also determine to inform of the operating condition of the washing machine 1 on the display unit 600. For example, when auxiliary water supply is stopped, the function determiner 420 may determine to inform the user that auxiliary water supply is stopped.

The aforementioned predetermined water level, predetermined time limit, first predetermined time, second predetermined time, and predetermined number of washes may be set based on the user's lifestyle pattern, specifications of the washing machine 1, the region in which the washing machine 1 is used, a type and amount of the laundry, etc., which may be input by the user through the input unit 500, or may be stored in the memory 790 in the manufacturing stage, or may be stored in the memory 790 based on analyzed results of the user's lifestyle pattern. In addition, various other attributes may also be used to set the predetermined water level, predetermined time limit, first predetermined time, second predetermined time, and predetermined number of washes.

The function determiner 420 may also determine whether to reuse washing water contained in the outer tub 21 based on the user's instruction input through the input unit 500 and the water level or turbidity of the washing water.

The function determiner 420 may send the determination about the function of the washing machine 1 to the drainage control unit 430, the water supply control unit 440, the display control unit 450, and the washing control unit 460.

The drainage control unit 430 may send a control signal to the drainage unit 900 to control the drainage unit 900, the water supply control unit 440 may send a control signal to the water supply unit 300 to control the water supply unit 300, the display control unit 450 may send a control signal to the display unit 600 to control the display unit 600, and the washing control unit 460 may send control signals to the driving unit 800, the main washing unit 20, the water supply unit 300, and the drainage unit 900 to control a washing operation of the washing machine 1.

The driving unit 800 generates a driving force to be delivered to the inner tub 22 and the pulsator 29 and used for main washing, and may be the same as the aforementioned driving unit 800 of FIG. 1.

The main washing unit 20 is a device for performing main washing, and may be the same as the aforementioned main washing unit 20 of FIG. 1.

The communication unit 700 may be connected to a network 740 via wire or wirelessly to communicate with other external electronic appliances 770 or a server 750. The communication unit 700 may exchange data with the server 750 connected through a home server, or other electronic appliances 770 in the house. The communication unit 700 may perform data communication conforming to a standard of the home server.

The communication unit 700 may send and receive remote-control-related data over the network 740, and send and receive information regarding operations of other electronic appliances 770. Further, the communication unit 700 may receive information about the user's lifestyle pattern from the server 750 and use the information for operation of the washing machine 1. The communication unit 700 may further perform data communication not only with the server 750 or remote controller 590 in the house but also with a portable terminal 760 of the user.

The communication unit 700 may be connected to a network 740 via cable or wirelessly, and send and receive data with the server 750, the remote controller 590, the portable terminal 760, or other electronic appliances 770 over the network 740. The communication unit 700 may include one or more components for communicating with the other external electronic appliances 770. For example, the communication unit 700 may include a short-range communication module 710, a wired communication module 720, and a mobile communication module 730.

The short-range communication module 710 may support short-range communication within a certain distance. The short-range communication may include a wireless LAN, Wi-Fi, Bluetooth, Zigbee, Wi-Fi Direct (WFD), Ultra Wideband (UWB), Infrared Data Association (IrDA), Bluetooth Low Energy (BLE), Near Field Communication (NFC), etc., but is not limited thereto.

The wired communication module 720 may support communication by means of electronic or optical signals. The wired communication may include a pair cable, a coaxial cable, a fiber optic cable, an Ethernet cable, etc., but is not limited thereto.

The mobile communication module 730 may transmit and receive RF signals to and from one of base stations, external terminals, and servers in the mobile communication network. The RF signal may include a voice call signal, a video call signal or different types of data involved in transmission/reception of a text/multimedia message.

Figure 9:
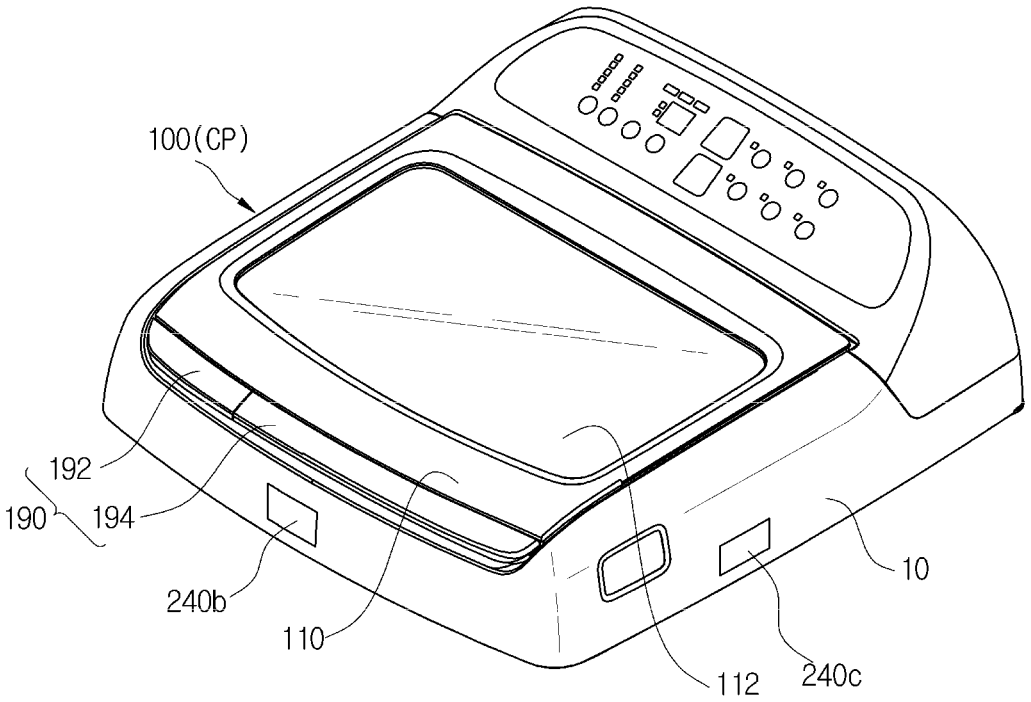
FIG. 9 is a perspective view of a door assembly in a closed position according to an embodiment of the disclosure.

The drainage unit 900 is for discharging the water stored in the outer tub from the washing machine 1, and may be the same as the aforementioned drainage unit 900 of FIG. 9.

An embodiment of the door assembly will be described below with reference to FIGS. 3 to 5.

Figure 3:
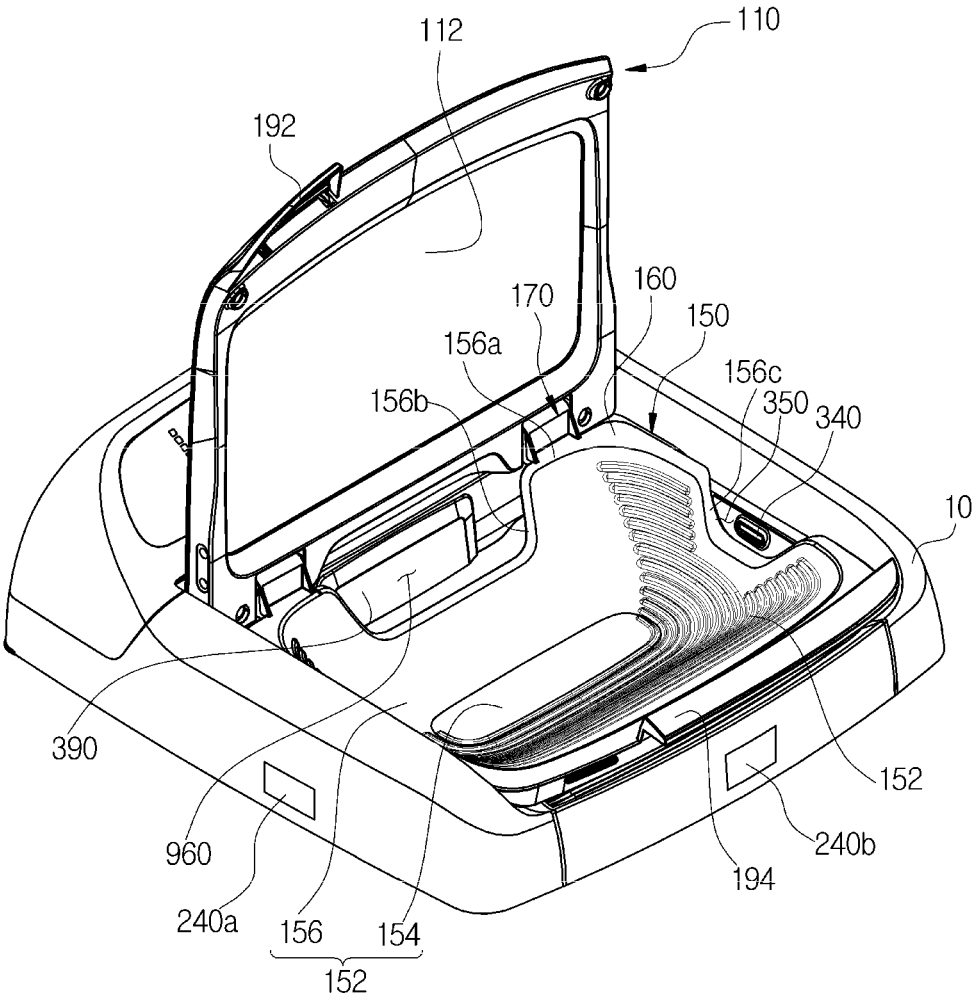
FIG. 3 is a perspective view of a washing machine with the door open according to an embodiment of the disclosure.
Figure 5:
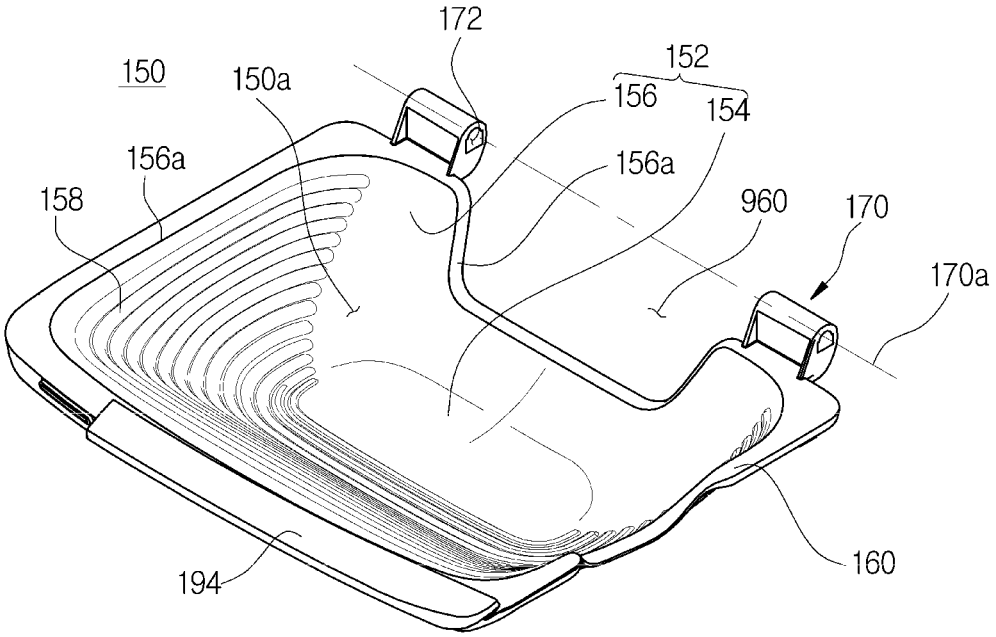
FIG. 5 is a perspective view of an auxiliary washing unit of a washing machine according to an embodiment of the disclosure.

FIG. 3 illustrates a washing machine with a door open, FIG. 4 illustrates an exploded view of a door assembly of a washing machine, and FIG. 5 illustrates an auxiliary washing unit.

The door assembly 100 may be arranged at the opening 90.

The door assembly 100 may include a door 110, an auxiliary washing unit 150, and a handle unit 190.

The door 110 may be disposed at one side of the main body 10 to open and close the opening 90. The door 110 may be formed of a transparent member 112 so that the inside is visible even when the door 110 closes the opening 90.

The auxiliary washing unit 150 may be configured to provide an auxiliary washing space 150*a* enabling to perform separate washing by hand. The auxiliary washing space 150*a* is separated from the main washing space 21*a* formed by the outer tub and inner tub.

The main washing space 21*a* and the auxiliary washing space 150*a* are separated from each other, providing independent washing spaces. Therefore, washing in the main washing space 21*a* and the auxiliary washing space 150*a* may be performed separately or simultaneously.

The auxiliary washing unit 150 may be disposed to be pivotable about one side inside the door 110. The auxiliary washing unit 150 may have the same rotational axis as the door 110.

Specifically, the door 110 may be mounted to pivot about a door pivot shaft 114*a*, and the auxiliary washing unit 150 may be mounted to pivot about an auxiliary pivot shaft 170*a*.

For example, the door pivot shaft 114*a* and the auxiliary pivot shaft 170*a* are arranged on the same side of the door 110 and the auxiliary washing unit 150, so that the door 110 and the auxiliary washing unit 150 pivot in the same direction. In other words, the door pivot shaft 114*a* and the auxiliary pivot shaft 170*a* are arranged on the same axis and correspond to each other.

For this, the door 110 may be pivotably combined with the main body 10 by means of door pivot parts 110*a* mounted on the main body 10 along the door pivot shaft 114*a*, and the auxiliary washing unit 150 may be pivotably combined with the door 110 by means of the auxiliary pivot parts 170.

The door pivot parts 110*a* may be formed to protrude from the main body 10 as projections in the direction of the door pivot shaft 114*a* such that the door 110 can pivot about the door pivot shaft 114*a*. Specifically, accommodation parts 114 may be mounted on the door 110, and the door pivot parts 110*a* may be inserted into the accommodation parts 114, so that the door 110 may be pivotably supported with respect to the main body 10.

However, they are not limited thereto, and may be formed to protrude from the outer side of the door 110 as projections in the direction of the door pivot shaft 114*a* such that the door 110 can pivot about the door pivot shaft 114*a*.

The door pivot part 110*a* is not limited to a particular form, and may be implemented in various forms that enable the door 110 to pivot with respect to the main body 10.

Insertion parts 116 may be mounted on one side of the door 110 as recesses to enable the auxiliary pivot parts 170 to pivot, and pivot protrusions 118 that protrude in the direction of the auxiliary pivot shaft 170*a* may be formed in the insertion parts 116 such that the auxiliary washing unit 150 can pivot about the auxiliary pivot shaft 170*a*.

On the auxiliary washing unit 150, pivot holes 172 may be formed to correspond to the pivot protrusions 118. The auxiliary pivot parts 170 may be inserted into parts of the door 110 such that the door pivot shaft 114*a* and the auxiliary pivot shaft 170*a* correspond to each other.

However, the structure or arrangement of the door 110 and auxiliary washing unit 150 is not limited thereto, and the door 110 and auxiliary washing unit 150 may be implemented in various other structures and arrangements to open and close the opening 90.

The auxiliary pivot part 170 may be formed to protrude from a unit body 152 such that the auxiliary pivot shaft 170*a* is separated from the unit body 152. Such a structure may increase a radius of rotation of the auxiliary washing unit 150 and prevent the unit body 152 from being interfered with by the door 110 or the main body 10 while the auxiliary washing unit 150 pivots.

The auxiliary washing unit 150 may include the unit body 152 comprised of a bottom part 154 and a side part 156, rubbing protrusions 158, an auxiliary drain 960, and a seating flange 160.

The auxiliary washing space 150*a* of the auxiliary washing unit 150 may be formed by the unit body 152. The bottom part 154 is a factor determining the depth of the auxiliary washing space 150*a*, and may be flat or curved. The side part 156 may be formed to be sloped toward the bottom part 154.

The bottom part 154 and the side part 156 may be formed to define the recessed auxiliary washing space 150*a* to enable separate washing with washing water supplied thereto.

The rubbing protrusions 158 may be formed on the unit body 152 to facilitate washing by hand. Although the rubbing protrusions are formed on the side part 156 in FIGS. 3 to 5, they are not limited thereto but may be implemented in various forms on the unit body 152.

The rubbing protrusions 158 serve to increase frictional force to the laundry in washing by hand so that dirt can be easily washed from the laundry. For this, the rubbing protrusions 158 may be protruded from their adjacent surfaces on the auxiliary washing unit 150. The rubbing protrusions 158 may be implemented in various other forms.

The auxiliary drain 960 may be formed to discharge the used washing water from the auxiliary washing space 150*a*. The auxiliary drain may be formed on the bottom part 154 of the auxiliary washing space 150*a* or the side part 156 of the unit body 152 as a hole with a separate opening and closing member. The auxiliary drain 960 may be configured to discharge the washing water contained in the auxiliary washing space 150*a* when the auxiliary washing unit 150 pivots to be inclined.

The auxiliary drain 960 may be defined by an edge 156*b* of the auxiliary drain 960 formed in the unit body 152 to be lower than the upper end 156*a* of the unit body 152. In other words, the auxiliary drain 960 may be formed in recession in the upper end 156*a* of the unit body 152. However, the auxiliary drain 960 may be implemented in various forms that enable the washing water contained in the auxiliary washing space 150*a* to be discharged when the auxiliary washing unit 150 is tilted.

The seating flange 160 may be formed along the edge of the upper end of the auxiliary washing unit 150 to be seated on the main body 10. In other words, the seating flange 160 may be formed in the shape of a flange along the upper end of the unit body 152.

On the inner side of the opening 90 of the main body 10, a seating part 90*a* may be formed to protrude from along the boundary of the opening 90. The seating flange 160 may be formed to be seated on the seating part 90*a*. Mounting the seating flange 160 on the seating part 90*a* may enable the auxiliary washing unit 150 to be secured to the main body 10.

The auxiliary washing unit 150 may be made of a thermoplastic resin. The auxiliary washing unit 150 may be made of an ABS material. Any material with high impact resistance and rigidity may also be used for the auxiliary washing unit 150.

Figure 6:
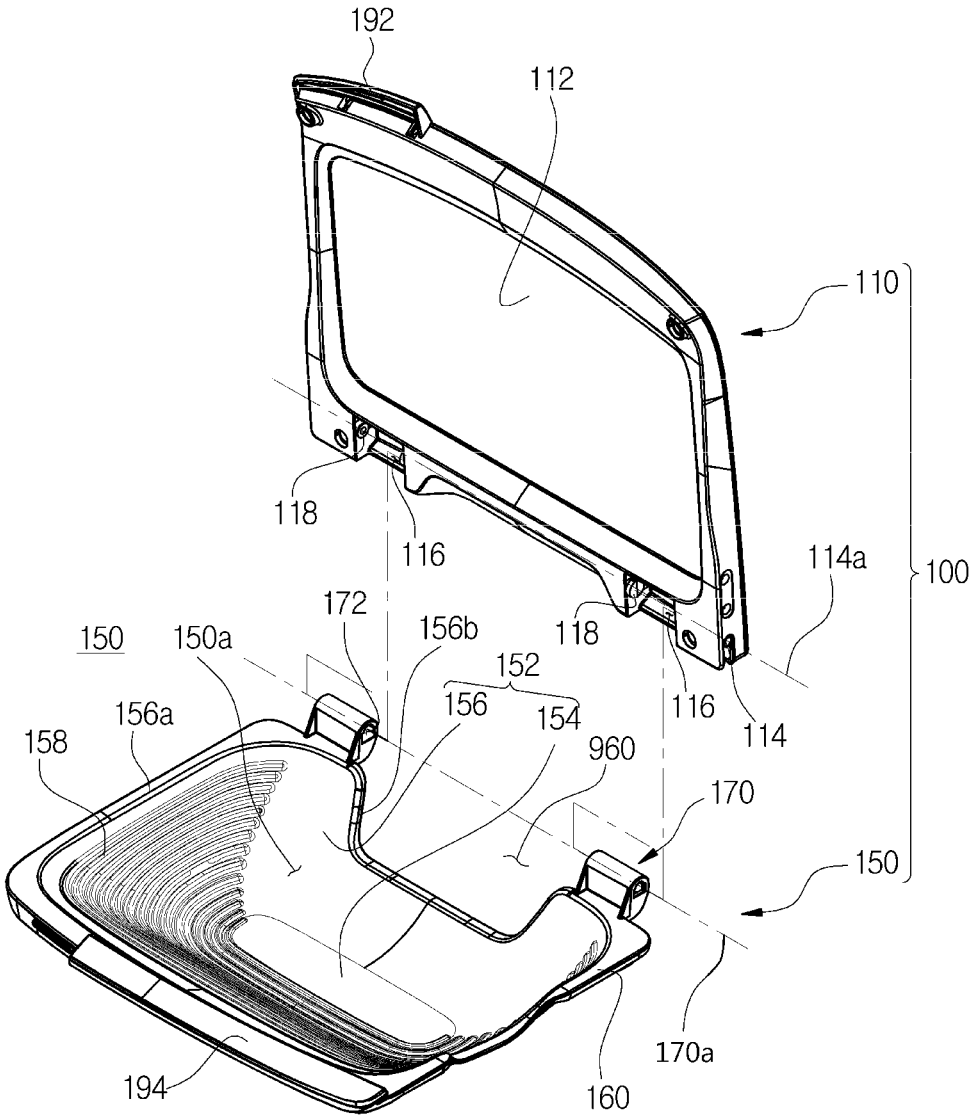
FIG. 6 is a perspective view of coupling of an auxiliary washing unit of a washing machine according to an embodiment of the disclosure.
Figure 7:
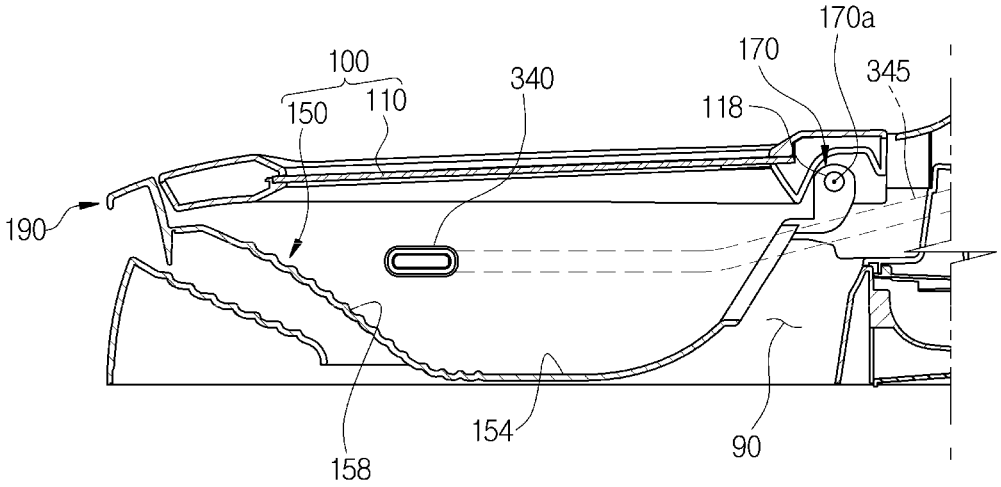
FIG. 7 is a cross-sectional view of a door assembly of a washing machine according to an embodiment of the disclosure.
Figure 8:
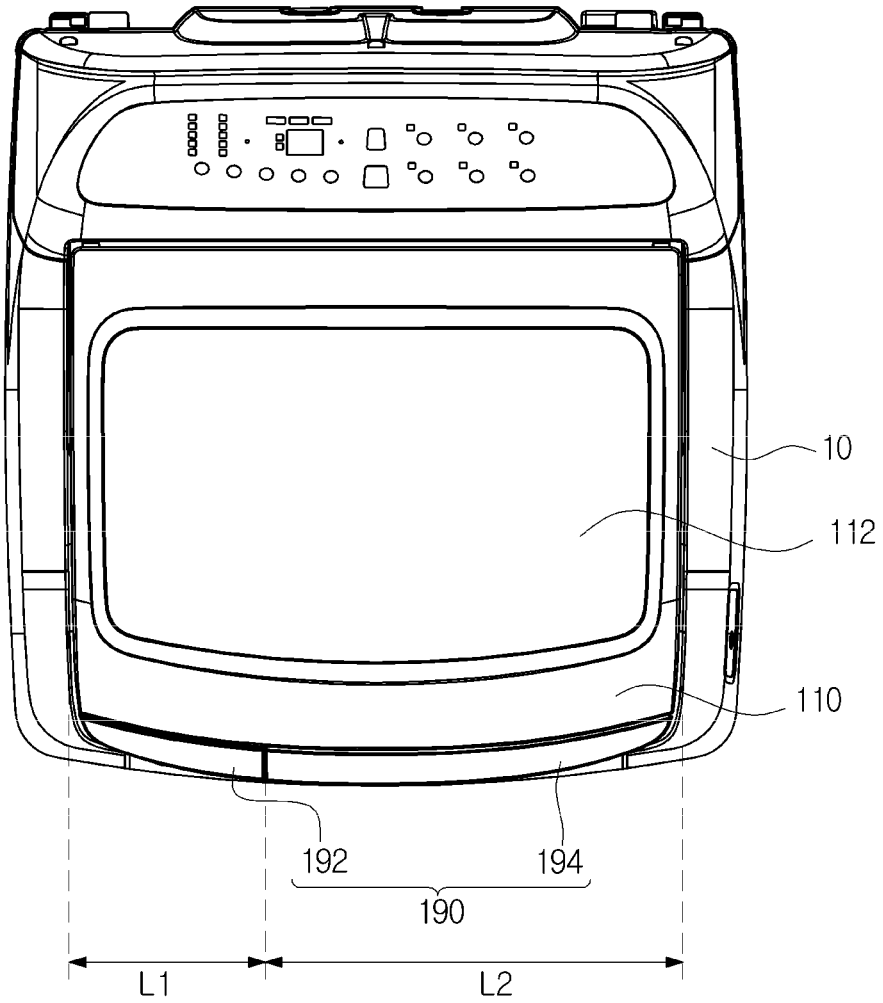
FIG. 8 is a top view of a washing machine according to an embodiment of the disclosure.

FIG. 6 shows combining an auxiliary assembly, and FIG. 7 shows a cross-sectional view of a door assembly of a washing machine. FIG. 8 is a top view of a washing machine.

The door 110 and the auxiliary washing unit 150 may each be mounted to be pivotable with respect to the main body 10.

The door 110 may be mounted to be able to pivot about a door pivot shaft 114*a*, and the auxiliary washing unit 150 may be mounted to be able to pivot about an auxiliary pivot shaft 170*a*.

The door pivot shaft 114*a* and the auxiliary pivot shaft 170*a* may be arranged on the same side of the door 110 and the auxiliary washing unit 150, such that the door 110 and the auxiliary washing unit 150 may pivot in the same direction.

The door pivot shaft 114*a* and the auxiliary pivot shaft 170*a* may be arranged on the same axis. That is, the door pivot shaft 114*a* and the auxiliary pivot shaft 170*a* may be arranged to be consistent with each other.

For this, the door 110 may be pivotably coupled to the main body 10 by means of door pivot parts 110*a* mounted on the main body 10 along the door pivot shaft 114*a*, and the auxiliary washing unit 150 may be pivotably coupled to the door 110 by means of the auxiliary pivot parts 170.

The door pivot parts 110*a* may be formed to protrude from the main body 10 as projections in the direction of the door pivot shaft 114*a* such that the door 110 can pivot about the door pivot shaft 114*a*. Specifically, accommodation parts 114 may be mounted on the door 110, and the door pivot parts 110*a* may be inserted into the accommodation parts 114, so that the door 110 may be pivotably supported on the main body 10. However, they are not limited thereto, and may be formed to protrude from the outer side of the door 110 as projections in the direction of the door pivot shaft 114*a* such that the door 110 can pivot about the door pivot shaft 114*a*. The door pivot parts 110*a* are not limited to any particular form, but may be implemented in any form that enables the door 110 to be pivot with respect to the main body 10.

Insertion parts 116 may be mounted on one side of the door 110 as recesses to enable the auxiliary pivot parts 170 to pivot, and pivot protrusions 118 that protrude in the direction of the auxiliary pivot shaft 170*a* may be formed in the insertion parts 116 such that the auxiliary washing unit 150 can pivot about the auxiliary pivot shaft 170*a*. Pivot holes 172 corresponding to the pivot protrusions 118 may be formed on the auxiliary washing unit 150. The auxiliary pivot parts 170 may be formed to be inserted into parts of the door 110 such that the door pivot shaft 114*a* and the auxiliary pivot shaft 170*a* correspond to each other.

However, the structure or arrangement in which the door 110 and auxiliary washing unit 150 pivot are not limited thereto, and may be implemented in various other ways as long as it enables the door 110 and the auxiliary washing unit 150 to open and close the opening 90.

The auxiliary pivot part 170 may be formed to protrude from the unit body 152 such that the auxiliary pivot shaft 170*a* may be separated from the unit body 152. Such a structure may increase a radius of rotation of the auxiliary washing unit 150 and prevent the unit body 152 from being interfered with by the door 110 or the main body 10 while the auxiliary washing unit 150 is pivoted.

The door assembly 100 may include the handle unit 190.

The handle unit 190 may include a door handle 192 provided on the door 110 and an auxiliary handle 194 provided on the auxiliary washing unit 150.

The door handle 192 may be arranged on the other side of the door 110 to correspond to the door pivot shaft 114*a* arranged on the one side of the door 110.

The auxiliary handle 194 may be arranged on the other side of the auxiliary washing unit 150 to correspond to the auxiliary pivot shaft 170*a* arranged on the one side of the auxiliary washing unit 150.

The door handle 192 and the auxiliary handle 194 may be aligned in the length direction. Furthermore, the door handle 192 and the auxiliary handle 194 may be arranged on the front surfaces of the door 110 and the auxiliary washing unit 150 to pivot the door 110 and the auxiliary washing unit 150, respectively. The door 110 may be pivoted with an operation of the door handle 192, and the auxiliary washing unit 150 may be pivoted alone or together with the door 110 with an operation of the auxiliary handle 194.

With respect to the front surface of the door assembly 100, the door handle 192 may be formed to have a first length L1 and the auxiliary handle 194 may be formed to have a second length L2 aligned with the first length L1. The door may be pivoted with the door handle 192, and when the door 110 is open, the auxiliary washing unit 150 may be pivoted with the auxiliary handle 194. When the door 110 is closed, the door 110 and the auxiliary washing unit 150 may be pivoted together with the auxiliary handle 194. Thus, considering the respective weights of the door 110 and the auxiliary washing unit 150, the second length L2 may be greater than the first length L1. That is, the auxiliary handle 194 may be longer than the door handle 192.

An operation of the door assembly of the washing machine with the aforementioned structure will now be described.

An embodiment of adjusting the position of the door assembly will be described with reference to FIGS. 9 to 11.

Figure 10:
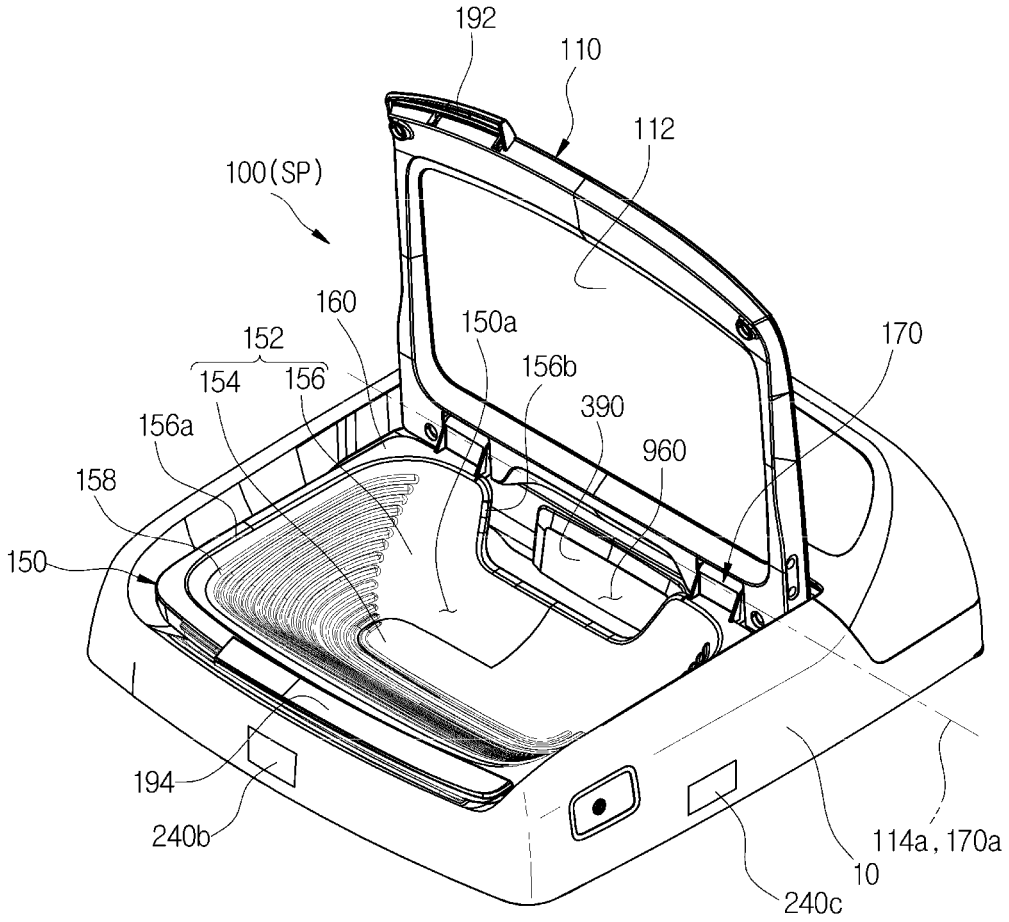
FIG. 10 is a perspective view of a door assembly in an auxiliary washing position according to an embodiment of the disclosure.
Figure 11:
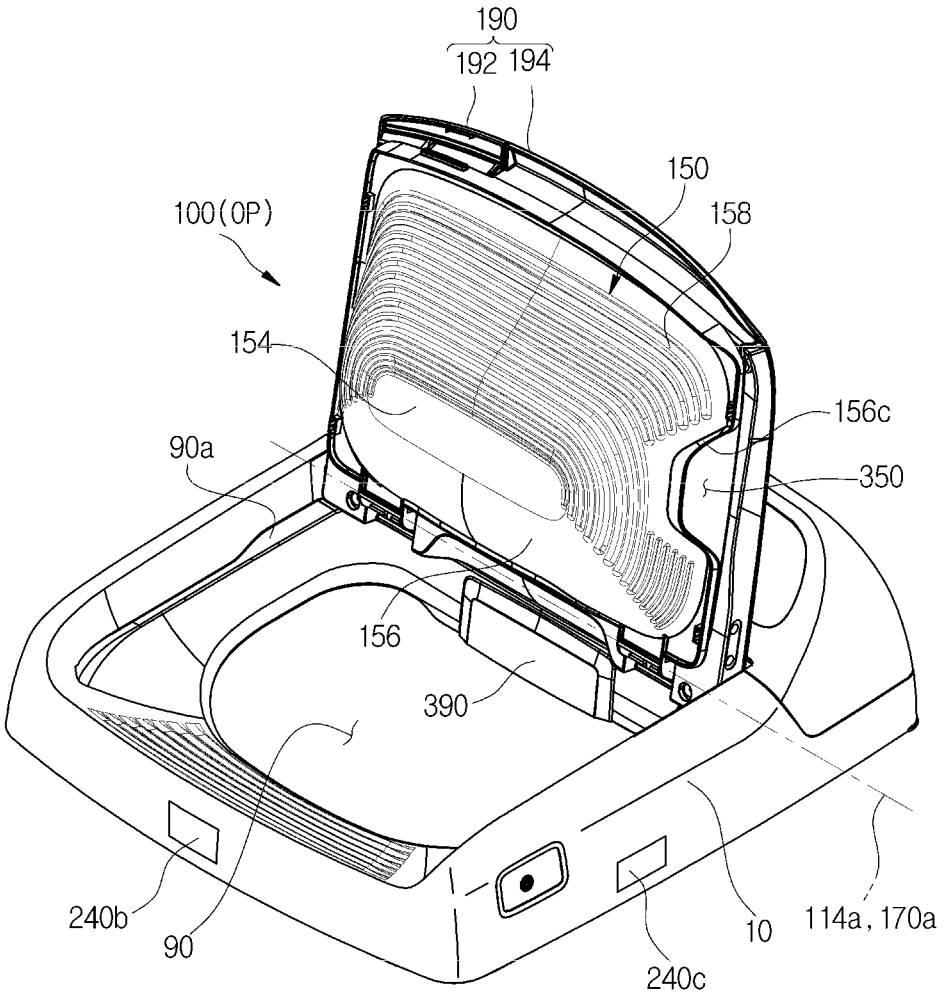
FIG. 11 is a perspective view of a door assembly in an open position according to an embodiment of the disclosure.

FIG. 9 shows a door assembly in the closed position, FIG. 10 shows a door assembly in the auxiliary washing position, and FIG. 11 shows a door assembly in the open position.

The door assembly 100 may pivot to a closed position CP, an auxiliary washing position SP, and an open position OP.

Specifically, the door assembly 100 may pivot between the closed position CP and the auxiliary washing position SP with the door handle 192, and between the closed position CP and the open position OP with the auxiliary handle 194.

The closed position CP refers to a position at which the door assembly 100 closes the opening 90 by placing the door 110 and the auxiliary washing unit 150 on top of the opening 90 to cover the opening 90. The auxiliary washing position SP refers to a position at which the door 110 has pivoted from the closed position to enable washing by hand in the auxiliary washing unit. The open position OP refers to a position to which the door 110 and the auxiliary washing unit 150 have pivoted from the closed position CP or the auxiliary washing position SP to enable the door assembly 100 to open the opening 90.

An operation of the auxiliary washing unit of the washing machine with the aforementioned structure will now be described.

Figure 12:
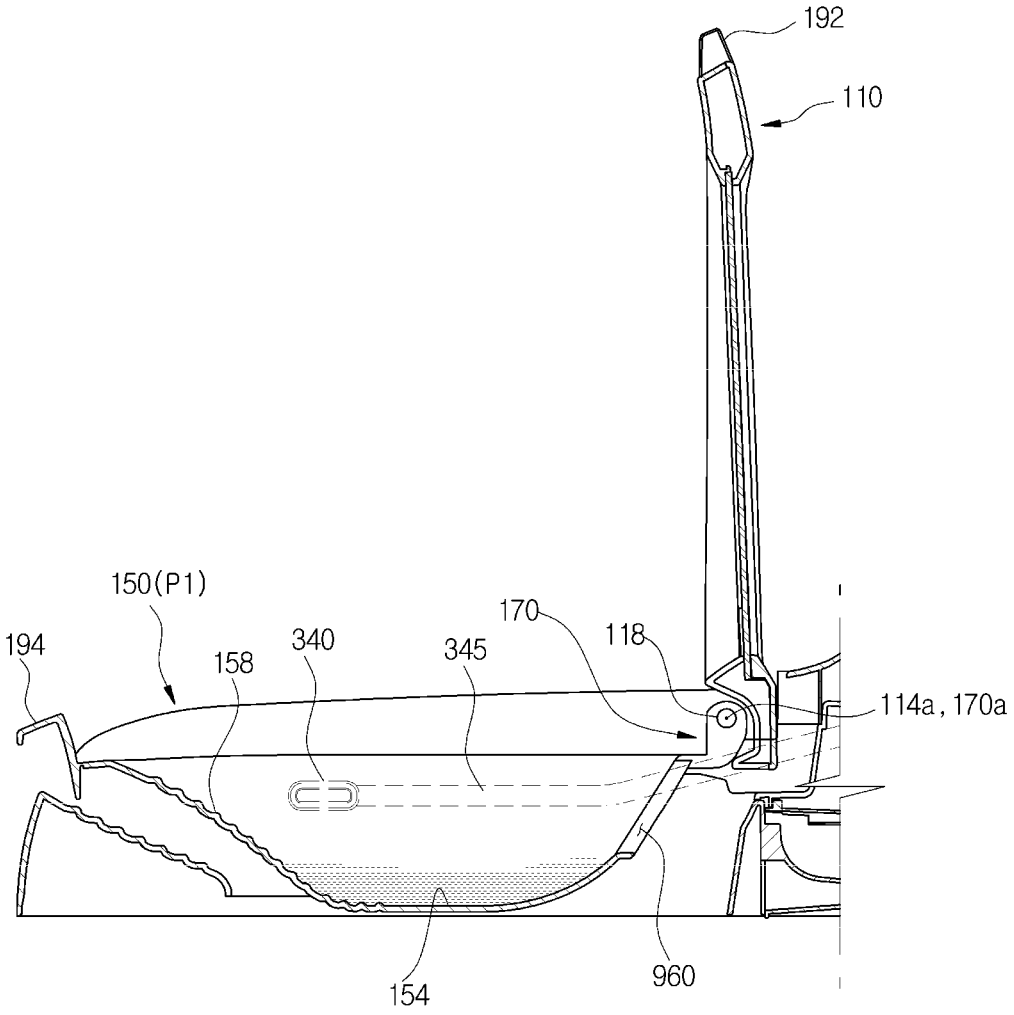
FIGS. 12 and 13 illustrate an operation of an auxiliary washing unit according to an embodiment of the disclosure.
Figure 13:
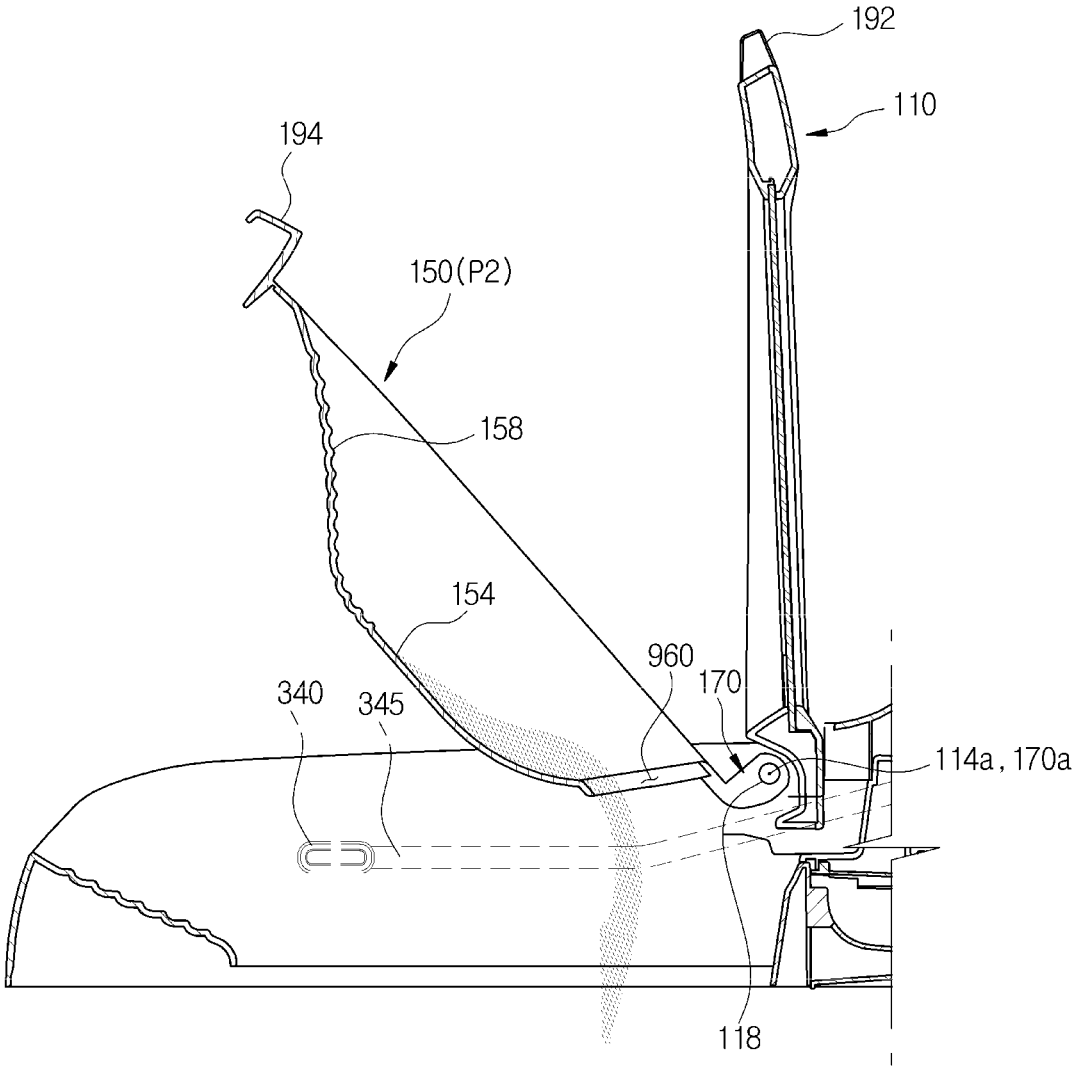

FIGS. 12 and 13 illustrate an operation of the auxiliary washing unit of the washing machine.

After washing by hand is completed in the auxiliary washing position SP of the door assembly 100, the used washing water may be discharged through the auxiliary drain 960 to the main washing space 21*a* or to the outside of the washing machine.

More specifically, the auxiliary washing unit 150 may pivot to a first position P1 at which the auxiliary washing unit 150 is placed when the door assembly 100 is in the auxiliary washing position SP, and to a second position P2 of the auxiliary washing unit 150 for the washing water in the auxiliary washing space 150*a* to be discharged through the auxiliary drain 960 to the main washing space 21*a* or to the outside of the washing machine. The second position P2 refers to a position to which the auxiliary washing unit 150 is tilted about the auxiliary pivot shaft 170*a* such that the washing water in the auxiliary washing space 150*a* is discharged through the auxiliary drain 960. The second position P2 may be located between the first position P1 and a position of the auxiliary washing unit 150 when the door assembly 100 is in the open position OP.

Since the auxiliary drain 960 may be formed at a lower height than the adjacent side part 156, washing water may be smoothly discharged through the auxiliary drain 960 without overflowing from the upper end of the side part 156 even though the auxiliary washing unit is further tilted.

The washing water discharged through the auxiliary drain 960 travels into the outer tub 21. That is, the washing water may be kept in the outer tub 21 without being drained from the washing machine. Here, an issue of whether to reuse the washing water coming in through the auxiliary drain 960 arises.

With the auxiliary washing unit 150, a particular stained part of clothing may be washed by hand, i.e., washing by hand may be performed. A contamination level of the washing water used in the washing by hand may be low enough to reuse the washing water in main washing in the main washing space. When all washing water that has been used in auxiliary washing is automatically drained away even in these cases, the total amount of washing water used to wash laundry may increase.

To address this issue, a washing machine and method for controlling the same are provided in accordance with an embodiment of the disclosure.

A method for supplying water to the washing machine according to an embodiment of the disclosure will be described with reference to FIGS. 14 to 18.

Figure 14:
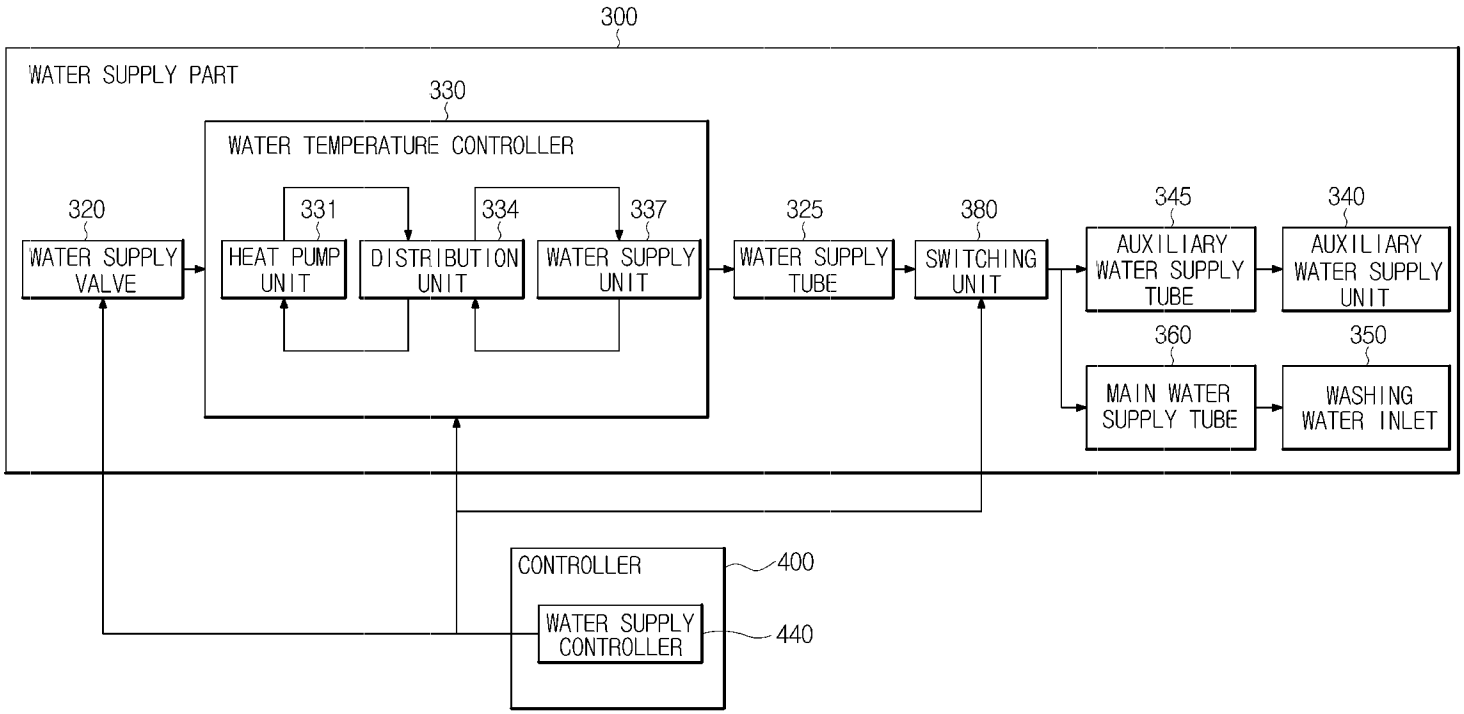
FIG. 14 is a block diagram of a water supply unit according to an embodiment of the disclosure.

FIG. 14 is a block diagram of a water supply unit.

The water supply unit 300 may include a water supply valve 320, a water supply tube 325, a switching unit 380, an auxiliary water supply tube 345, an auxiliary water supply outlet 340, a main water supply tube 360, a washing water inlet 350, and a water temperature control unit 330.

The water supply valve 320, the water supply tube 325, the switching unit 380, the auxiliary water supply tube 345, the auxiliary water supply outlet 340, the main water supply tube 360, and the washing water inlet 350 may be the same as the aforementioned water supply valve 320, the water supply tube 325, the switching unit 380, the auxiliary water supply tube 345, the auxiliary water supply outlet 340, the main water supply tube 360, and the washing water inlet 350 shown in FIGS. 1 and 2.

The water temperature control unit 330 is a device for cooling or heating water delivered through the water supply valve 320.

The water temperature control unit 330 may include a heat pump unit 331 for radiating heat from refrigerants, a heated-water supply unit 337 for producing cold water or hot water, and a distribution unit 334 for supplying the refrigerants and water to the heated-water supply unit 337.

In order for the refrigerants to be delivered and retrieved, the distribution unit 334 and the heat pump unit 331 may be interconnected through a refrigerant tube, and the distribution unit 334 and the heated-water supply unit 337 may be also interconnected through a refrigerant tube.

For water delivery and collecting, the distribution unit 334 and the heated-water supply unit 337 may be connected through a water supply tube and a water collecting tube.

The heat pump unit 331 may include a main compressor for compressing refrigerants, a first heat exchanger for exchanging heat between outside air and refrigerants, a four-way valve for selectively distributing refrigerants discharged from the main compressor to one of the first heat exchanger and the distribution unit 334, an outdoor electronic valve for adjusting a degree of opening and pressure relief and expansion of the refrigerants distributed by the distribution unit 334 before the refrigerants are delivered to the first heat exchanger, and an accumulator mounted on the intake end of the main compressor for preventing refrigerants from coming into the main compressor.

The heated-water supply unit 337 may include a second heat exchanger for exchanging heat between refrigerants delivered from the distribution unit 334 and water, and there may be a plurality of refrigerant tubes attached to either side of the second heat exchanger for allowing the refrigerants delivered through one of the plurality of refrigerant tubes to exchange heat with water and then be delivered back to the distribution unit 334 through another one of the plurality of refrigerant tubes.

The distribution unit 334 may include a refrigerant flow path switching valve for delivering refrigerants delivered from the heat pump unit 331 to the heated-water supply unit 337 when hot water is supplied, and delivering refrigerants delivered from the heated-water supply unit 337 to the heat pump unit 331 when cold water is supplied, and a water flow path switching valve for delivering water delivered through the water supply valve 320 to the heated-water supply unit 337.

The distribution unit 334 may include a plurality of electronic valves for controlling degrees of opening, which may be used as expansion valves or opening and closing valves.

The electronic valve may serve as an expansion valve to relieve pressure on and expand the refrigerants delivered from the distribution unit 334 before they are delivered to the second heat exchanger when cold water is supplied through the heated-water supply unit 337.

The electronic valve may serve as an opening and closing valve to prevent refrigerants from being delivered to the heated-water supply unit 337 when hot water is supplied through the heated-water supply unit 337.

With the aforementioned structure, when the water temperature control unit 330 supplies cold water, refrigerants discharged from the main compressor may be delivered to the first heat exchanger through the refrigerant tube and the four-way valve to be cooled, or delivered to the second heat exchanger through the refrigerant tube. Since the electronic valves may be installed in the refrigerant tube, the refrigerants may undergo pressure relief and expansion while passing through the electronic valves and then be delivered to the second heat exchanger. In the second heat exchanger, the refrigerants may absorb heat from water and then be delivered back to the main compressor through the refrigerant tube and the refrigerant flow path switching valve.

Meanwhile, the water delivered through the water supply valve 320 may be delivered to the second heat exchanger through the water flow path switching valve and the water supply tube, lose heat by refrigerants in the second heat exchanger, and then return to the distribution unit 334 through the water collecting tube and be supplied to a device that uses the water.

On the other hand, when the water temperature control unit 330 supplies hot water, refrigerants discharged from the main compressor may be delivered to the second heat exchanger through the refrigerant tube, the four-way valve, and the refrigerant flow path switching valve, heat water in the second heat exchanger, and then pass through the refrigerant tube to the first heat exchanger. Since the outdoor electronic valves may be installed in the refrigerant tube, the refrigerants may undergo pressure relief and expansion while passing through the outdoor electronic valves and then be delivered to the first heat exchanger. The refrigerants may absorb heat from outdoor air and then be delivered back to the main compressor through the refrigerant tube.

Meanwhile, the water delivered through the water supply valve 320 may be delivered to the second heat exchanger through the water flow path switching valve and the water supply tube, heated by the refrigerants to a desired temperature in the second heat exchanger, and then returned to the distribution unit 334 through the water collecting tube and supplied to a device that uses the water.

With the water supply temperature control unit 330, the user may be provided with washing water at a desired temperature.

Figure 15:
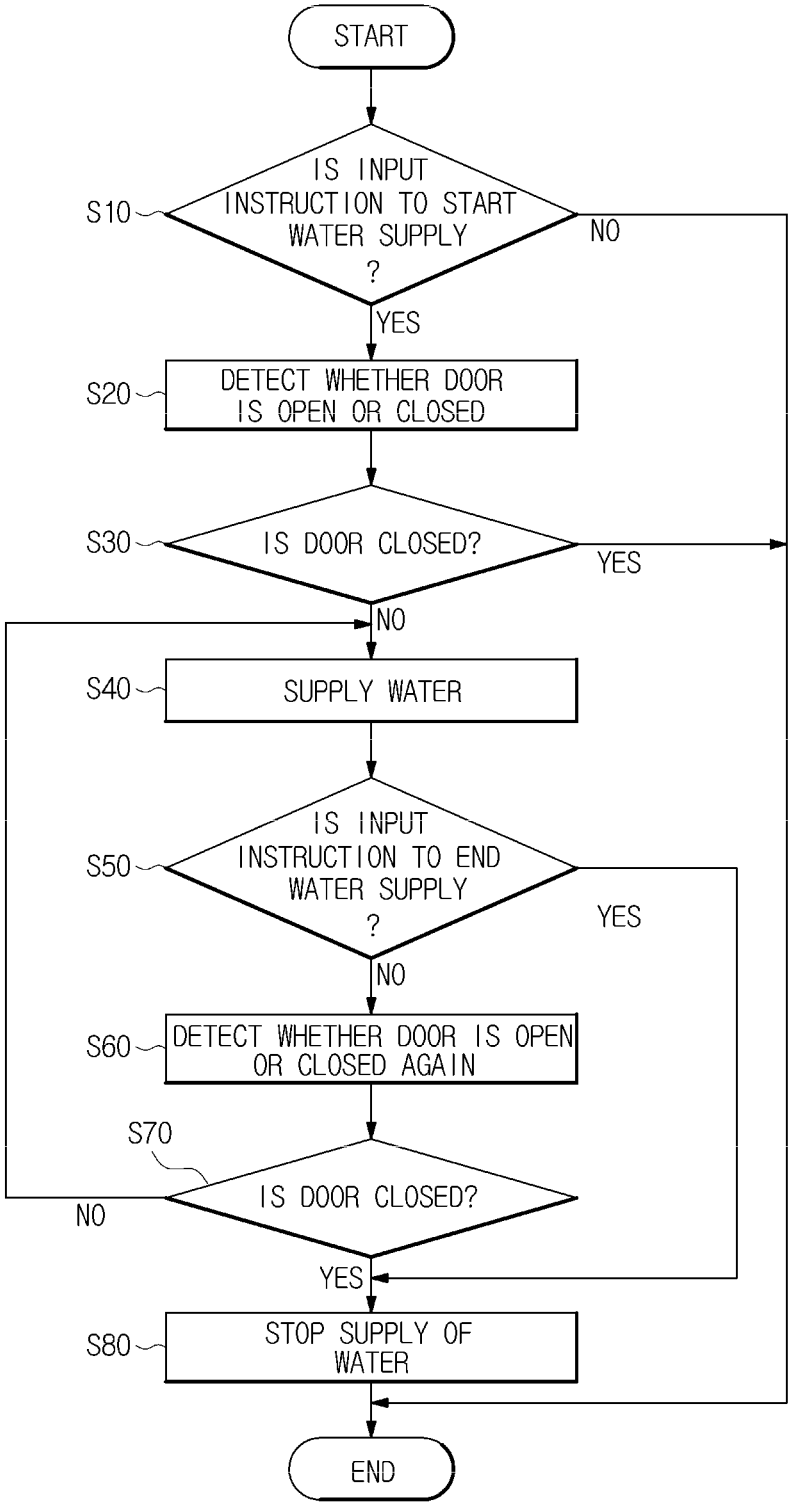
FIG. 15 is a flowchart illustrating a method for controlling auxiliary water supply in response to opening and closing of a door according to an embodiment of the disclosure.
Figure 18:
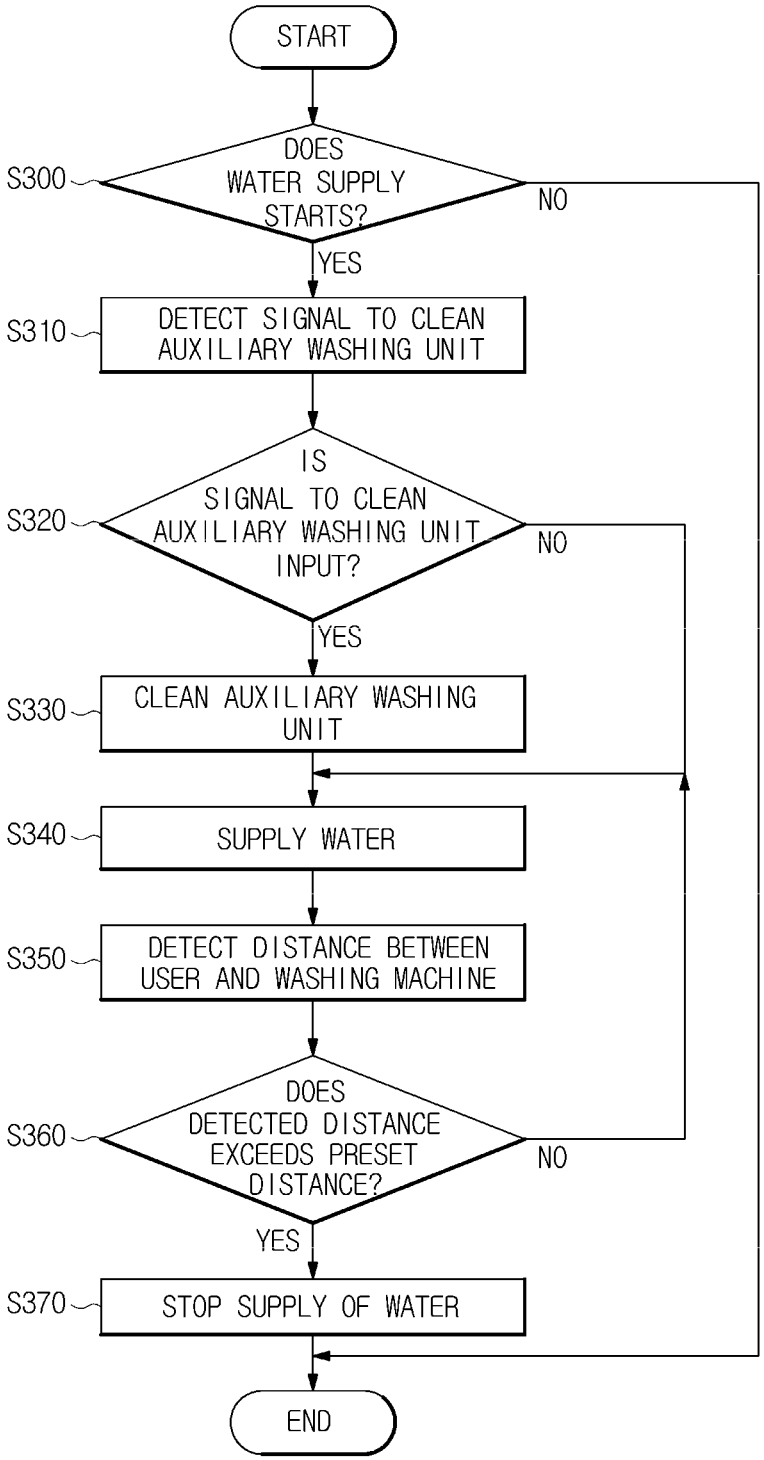
FIG. 18 is a flowchart illustrating a method for stopping auxiliary water supply and cleaning an auxiliary washing unit based on a distance to a user according to an embodiment of the disclosure.

Referring to FIGS. 15 and 18, an embodiment of a method for controlling the washing machine is described.

FIG. 15 is a flowchart illustrating a method for controlling auxiliary water supply in response to a state of the door.

First, the control unit determines whether an instruction to start water supply is input through the input unit in step S10.

When the instruction is not input, the control unit stops operation of auxiliary washing. Otherwise, when the instruction is input, the sensing unit senses whether the door is open or closed in step S20.

The control unit determines whether the door is closed based on the corresponding signal of whether the door is open or closed received from the sensing unit in step S30.

When the door is closed, the control unit stops operation of auxiliary washing. Otherwise, when the door is not closed, the control unit controls the water supply unit to supply auxiliary water to the auxiliary washing unit in step S40.

While auxiliary water is supplied, the control unit determines if an instruction to stop water supply is input through the input unit in step S50.

When the instruction to stop water supply is input, the control unit stops auxiliary water supply in step S80. Otherwise, when the instruction to stop water supply is not input, the control unit continues the auxiliary water supply and the sensing unit senses again whether the door is open or closed in step S60.

The control unit determines whether the door is closed based on the corresponding signal of whether the door is open or closed received again from the sensing unit in step S70.

When the door is closed, the control unit controls the auxiliary water supply to be stopped in step S80. Otherwise, when the door is not closed, the control unit controls steps S40, S50, and S70 to be performed again.

Figure 16:
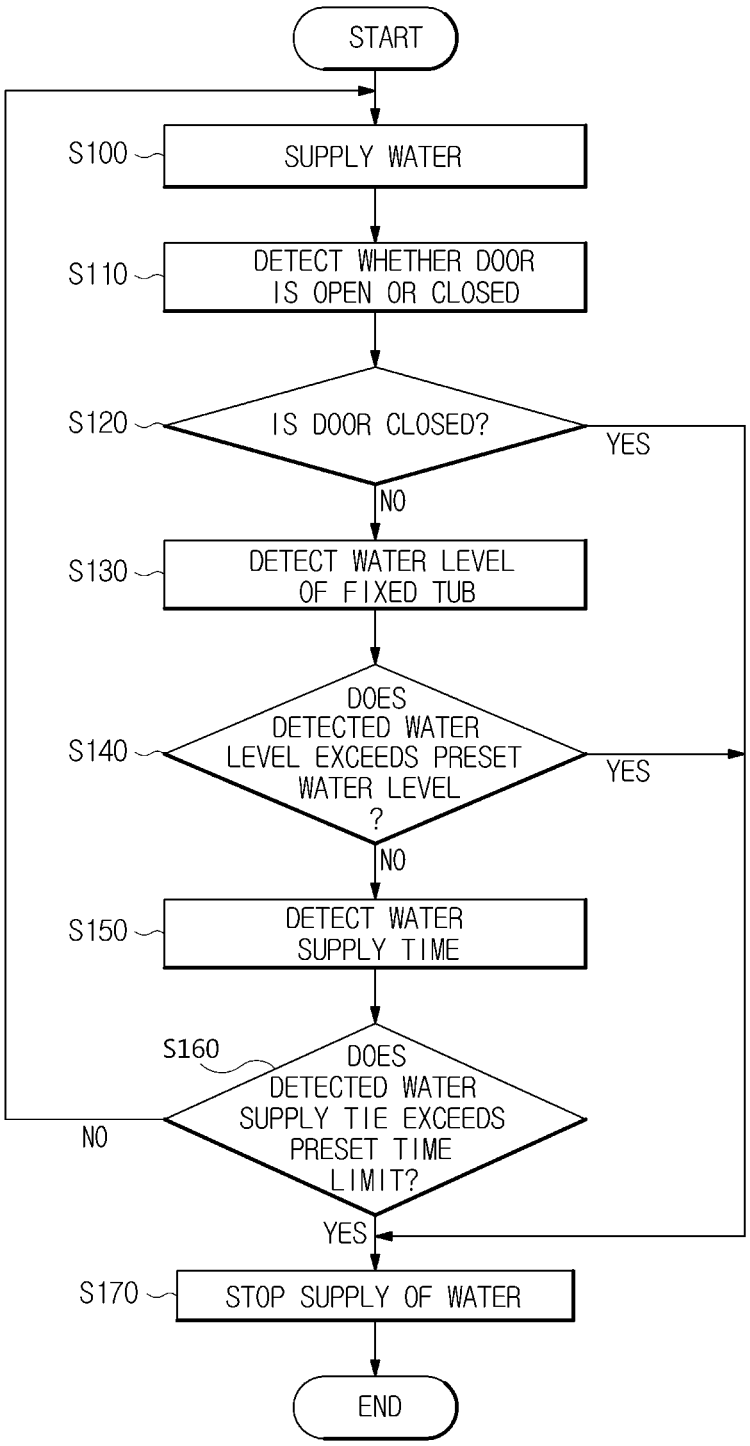
FIG. 16 is a flowchart illustrating a method for controlling auxiliary water supply to be stopped based on a measured water level and measured water supply time duration according to an embodiment of the disclosure.

FIG. 16 is a flowchart illustrating a method for controlling auxiliary water supply to be stopped based on a measured water level and measured water supply time duration.

First, the control unit controls auxiliary water supply to the auxiliary washing unit to proceed in step S100, and the sensing unit senses whether the door is open or closed in step S110 and provides the corresponding signal to the control unit. Then, in step S120, the control unit determines if the door is currently closed based on the corresponding signal provided from the sensing unit.

When the door is closed, the control unit controls the auxiliary water supply to the auxiliary washing unit to be stopped in step S170. Otherwise, when the door is not closed, the sensing unit measures a water level in the outer tub in step S130, and provides the corresponding signal to the control unit.

The control unit determines whether the water level is equal to or greater than a predetermined water level based on the corresponding signal provided from the sensing unit in step S140. The predetermined water level may be a value set and stored in the memory in the manufacturing stage, a value input by the user through the input unit, or a value stored in the memory based on analysis of the user's lifestyle pattern.

When the water level is equal to or greater than the predetermined water level, the control unit controls the auxiliary water supply to the auxiliary washing unit to be stopped in step S170. Otherwise, when the water level is lower than the predetermined level, the sensing unit measures an auxiliary water supply time duration for which the water supply unit has supplied water to the auxiliary washing unit in step S150, and provides the corresponding signal to the control unit.

The control unit determines whether the measured auxiliary water supply time duration is equal to or greater than a predetermined time limit based on the corresponding signal provided from the sensing unit in step S160. The predetermined time limit may be a value set and stored in the memory in the manufacturing stage, a value input by the user through the input unit, or a value stored in the memory based on analysis of the user's lifestyle pattern.

When the measured water supply time duration is lower than the predetermined time limit, the washing machine performs steps S100, S110, S120, S130, S140, and S150 again. Otherwise, when the measured water supply time duration is equal to or greater than the predetermined time limit, the control unit controls the water supply unit to stop auxiliary water supply to the auxiliary washing unit in step S170.

Figure 17:
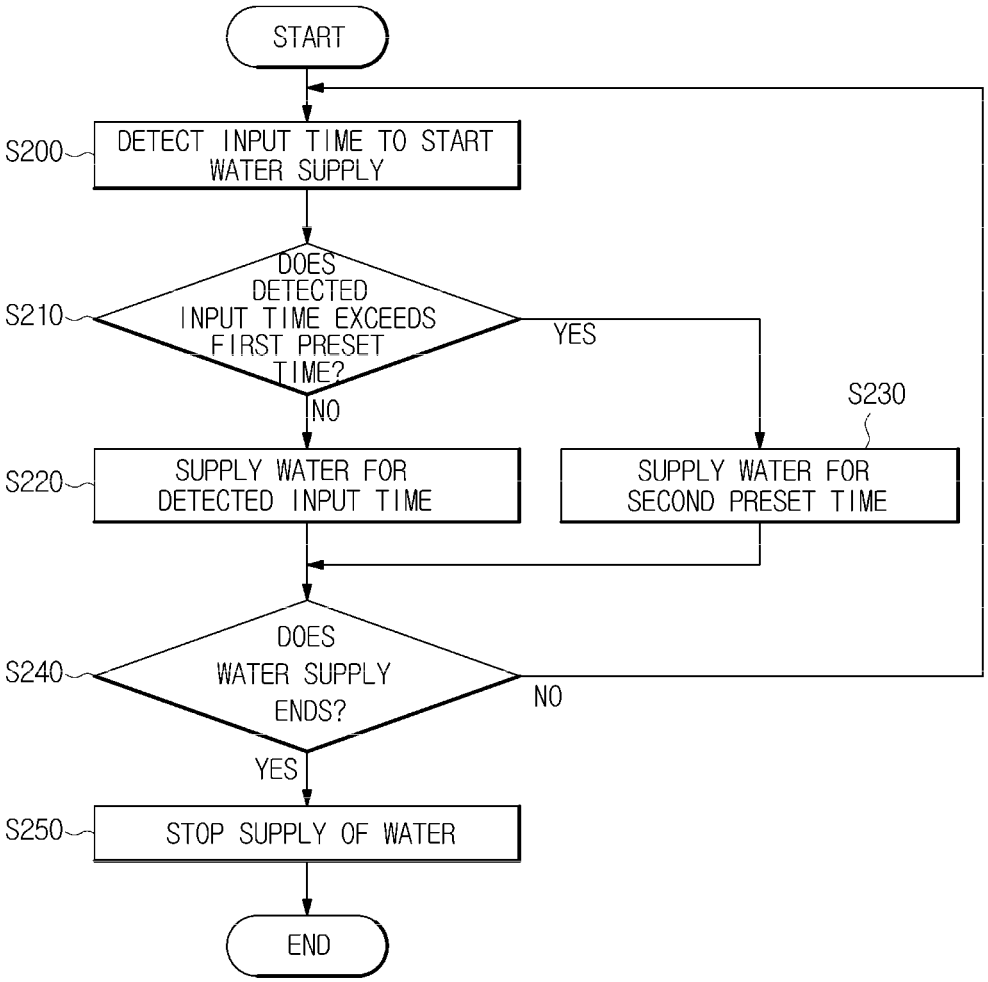
FIG. 17 is a flowchart illustrating a method for controlling an auxiliary water supply time duration based on an input time duration for receiving an instruction to start water supply according to an embodiment of the disclosure.

FIG. 17 is a flowchart illustrating a method for controlling an auxiliary water supply time duration based on an input time duration for receiving an instruction to start water supply.

First, the sensing unit measures an input time duration for receiving an instruction to start water supply input by the user through the input unit in step S200 and provides a corresponding signal to the control unit.

The control unit determines whether the measured input time duration exceeds a first predetermined time based on the corresponding signal provided from the sensing unit in step S210. The first predetermined time may be a value that is set in the manufacturing stage and stored in the memory, a value that is input by the user through the input unit, or a value that is stored in the memory based on analysis of the user's lifestyle pattern.

When the input time duration does not exceed the first predetermined time, the control unit controls the water supply unit to perform auxiliary water supply to the auxiliary washing unit for the measured input time duration in step S220.

Otherwise, when the measured input time duration exceeds the first predetermined time, the control unit controls the water supply unit to perform auxiliary water supply to the auxiliary washing unit for the second predetermined time in step S230. The second predetermined time may be a value that is set in the manufacturing stage and stored in the memory, a value that is input by the user through the input unit, or a value that is stored in the memory based on analysis of the user's lifestyle pattern.

The control unit determines whether the water supply unit is to stop supplying water to the auxiliary washing unit in step S240.

When the auxiliary water supply is not to be stopped, the washing machine performs steps S200, S210, S220 and S230 again. When the auxiliary water supply is to be stopped, the control unit controls the water supply unit to stop supplying water to the auxiliary washing unit in step S250.

FIG. 18 is a flowchart illustrating a method for stopping auxiliary water supply and cleaning the auxiliary washing unit based on a distance to the user.

First, the control unit determines whether the water supply unit is to start auxiliary water supply in step S300.

When auxiliary water supply is not to be started, the washing machine stops the operation of auxiliary washing. Otherwise, when auxiliary water supply is to be started, the control unit determines whether the input unit sends an instruction to clean the auxiliary washing unit in step S310.

The control unit then determines whether the instruction to clean the auxiliary washing unit is received in step S320.

When the instruction to clean the auxiliary washing unit is not received, the control unit controls the water supply unit to supply water to the auxiliary washing unit in step S340. Otherwise, when the instruction to clean the auxiliary washing unit is received, the control unit controls the water supply unit to clean the auxiliary washing unit in step S330, and after cleaning of the auxiliary washing unit, to supply water to the auxiliary washing unit in step S340.

Cleaning the auxiliary washing unit may be performed by the water supply unit supplying water to the auxiliary washing unit a predetermined number of times at certain time intervals. The predetermined number of times and certain intervals may be set and stored in the memory in the manufacturing stage, input by the user through the input unit, or stored in the memory based on analysis of the user's lifestyle pattern.

The sensing unit measures a distance between the user and the washing machine while the water supply unit supplies water to the auxiliary washing unit in step S350, and provides the corresponding signal to the control unit.

The control unit determines whether the distance between the user and the washing machine is equal to or greater than a predetermined distance based on the corresponding signal provided from the sensing unit in step S360. The predetermined distance may be a value set and stored in the memory in the manufacturing stage, a value input by the user through the input unit, or a value stored in the memory based on analysis of the user's lifestyle pattern.

When the distance is lower than the predetermined distance, the washing machine performs steps S340 and S350 again. When the measured distance is equal to or greater than the predetermined distance, the control unit controls the water supply unit to stop supplying water to the auxiliary washing unit in step S370.

Embodiments of a draining method of the washing machine will be described with reference to FIGS. 19 to 32.

Figure 19:
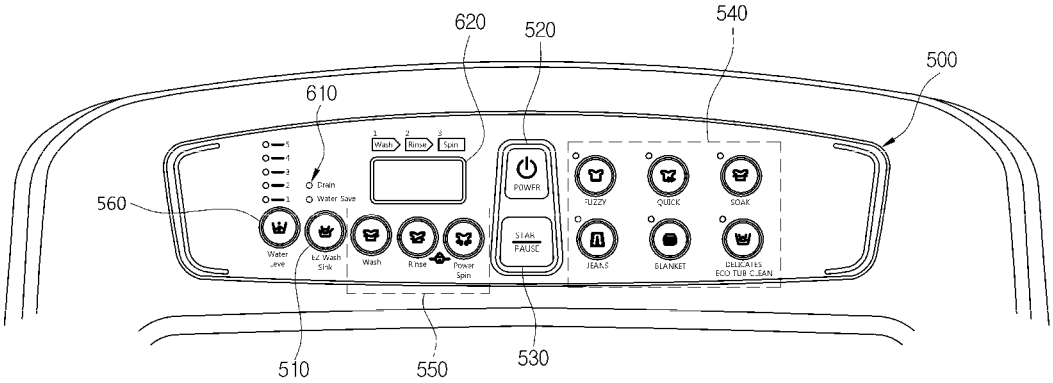
FIG. 19 illustrates an input unit according to an embodiment of the disclosure.

FIG. 19 illustrates the input unit 500 of the washing machine.

In FIG. 19, the input unit 500 includes press buttons as an example.

The input unit 500 may include a drain input button 510 for receiving an instruction for water drainage, a power button 520 for receiving power on/off instructions, a start button 530 for receiving instructions to start or pause washing, a washing method selection button 540 for receiving selections of washing methods, a cycle selection button 550 for receiving selections of cycles, and a water level selection button 560 for receiving an instruction to set up a water level.

Upon reception of an instruction for water drainage through the input unit 500, the control unit 400 may control the drainage unit 900 to drain washing water contained in the outer tub 21.

Specifically, the control unit 400 may control the drainage valve 930 of the drainage unit 900 to drain the washing water. Washing water flows into the drain 910 and travels through the first drainage tube 920. Since the first drainage tube 920 is connected to the drainage valve 930 for controlling drainage, the control unit 400 may control the drainage valve 930 for the washing water to travel from the first drainage tube 920 to the second drainage tube 940 through the drainage valve 930.

Unlike in this embodiment, the drainage unit 900 may include a drainage pump for applying pressure to the washing water. When pressure is applied to the washing water contained in the outer tub 21, it may force the washing water to be drained to the outside through the drain 910. Accordingly, the control unit 400 may control the drainage pump to drain the washing water.

The display unit 600 may inform the user that the instruction for drainage has been received.

The display unit 600 may be modified in various other forms within the technical ideas of informing the user that an instruction for drainage has been received. For example, the display unit 600 may visibly display or audibly present to the user receiving the instruction for drainage.

To visibly display receiving the instruction for drainage, the display unit 600 may include a light emitting diode (LED). The LED may be turned on when the instruction for drainage has been received, so the user can visually recognize that the instruction for drainage has been received by checking the LED status.

Alternatively, the display unit 600 may include a display panel 620. By displaying predetermined letters, numbers, or symbols on the display panel 620 to indicate that the instruction for drainage has been received, the user can visually recognize that the instruction for drainage has been received by checking the display panel 620.

The display unit 600 may be arranged to be adjacent to the input unit 500. When the display unit 600 is arranged to be adjacent to the input unit 500, the user may immediately check a result corresponding to his/her instruction input through the input unit 500.

Figure 23:
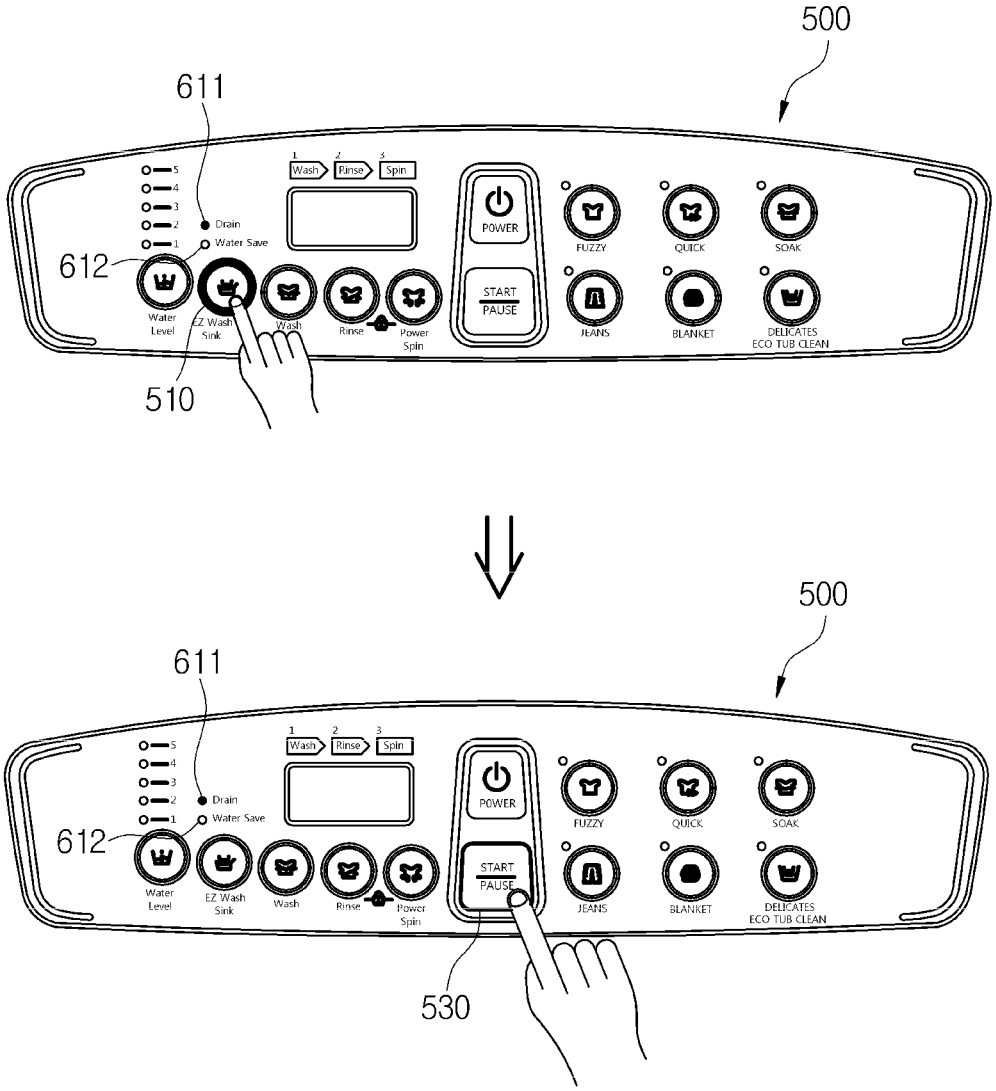
FIGS. 23 and 24 are diagrams for explaining how washing water contained in an outer tub is drained in response to a user instruction according to an embodiment of the disclosure.

As shown in FIG. 19 and FIG. 23, as the display unit 600, there may be a drainage selection indicator LED 611 and a washing water reuse selection indicator LED 612 arranged above the drain input button 510. An on/off operation of an LED 610 in response to user instructions will be described later.

Figure 20:
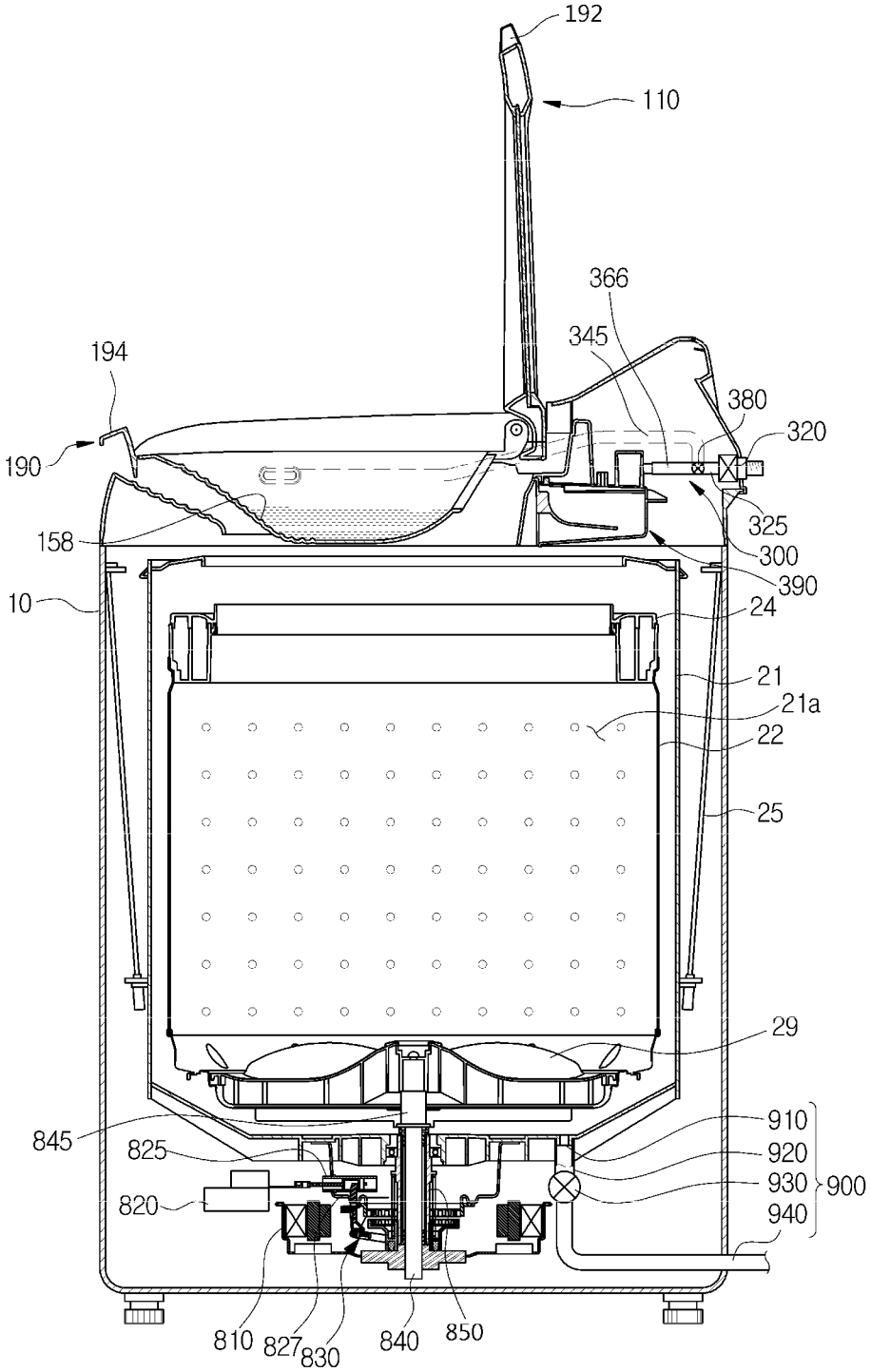
FIG. 20 illustrates a washing machine with an auxiliary washing unit to which water is supplied according to a user instruction according to an embodiment of the disclosure.
Figure 21:
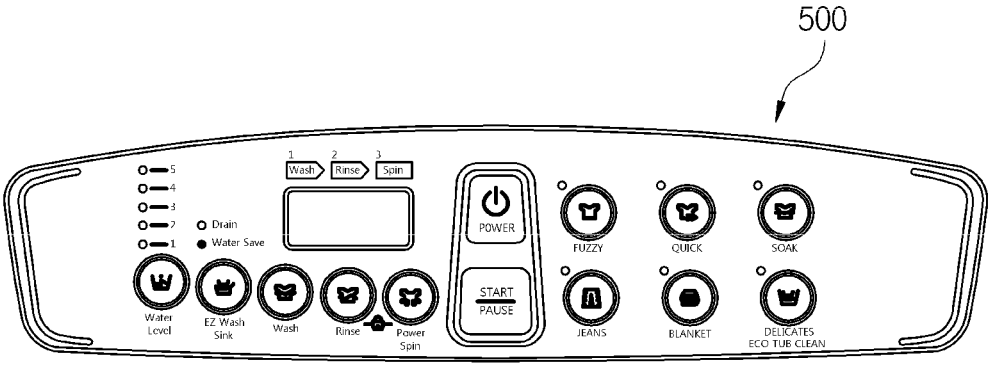
FIGS. 21 and 22 are diagrams for explaining how washing water is discharged into an outer tub from an auxiliary washing unit according to an embodiment of the disclosure.
Figure 22:
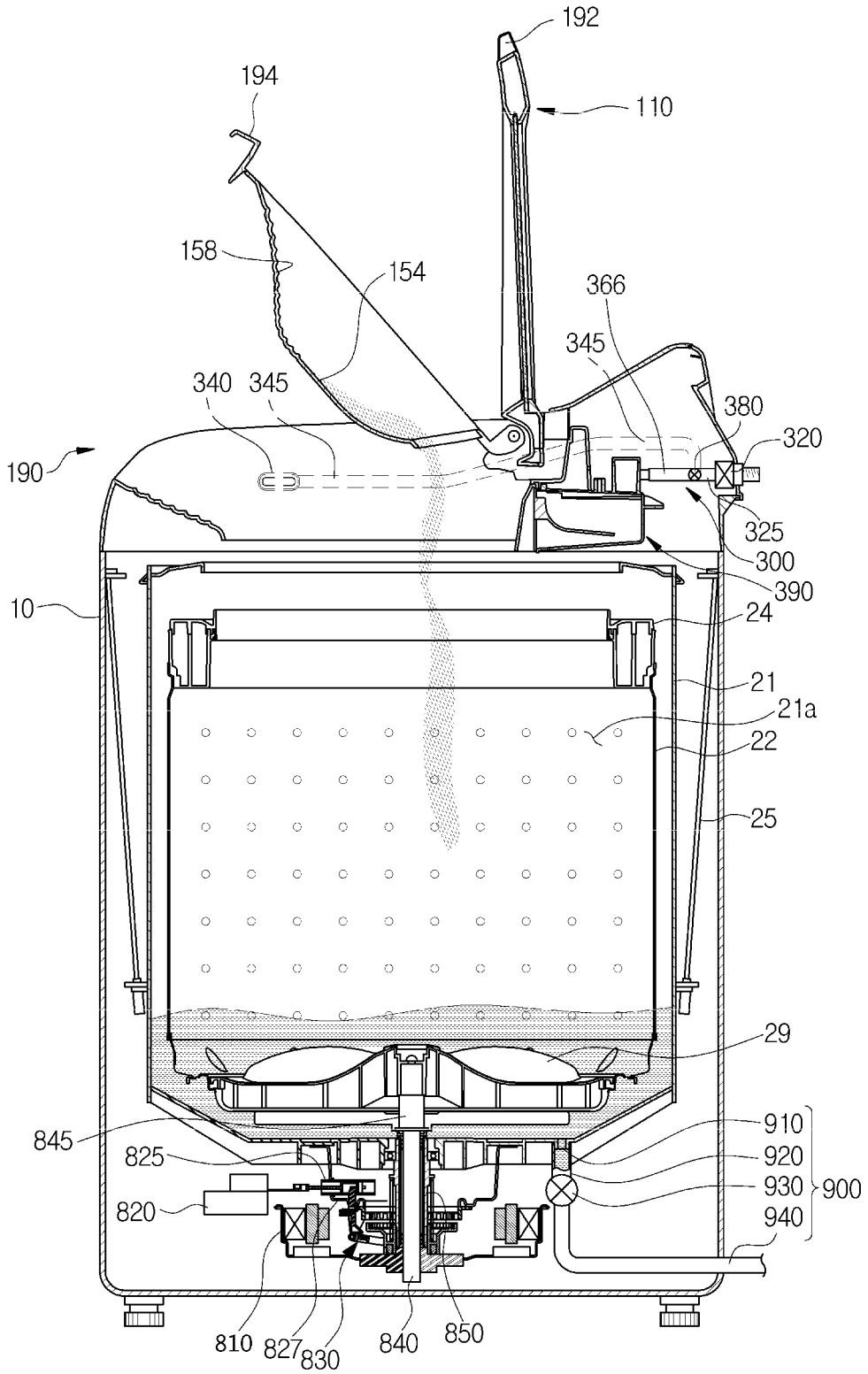
Figure 24:
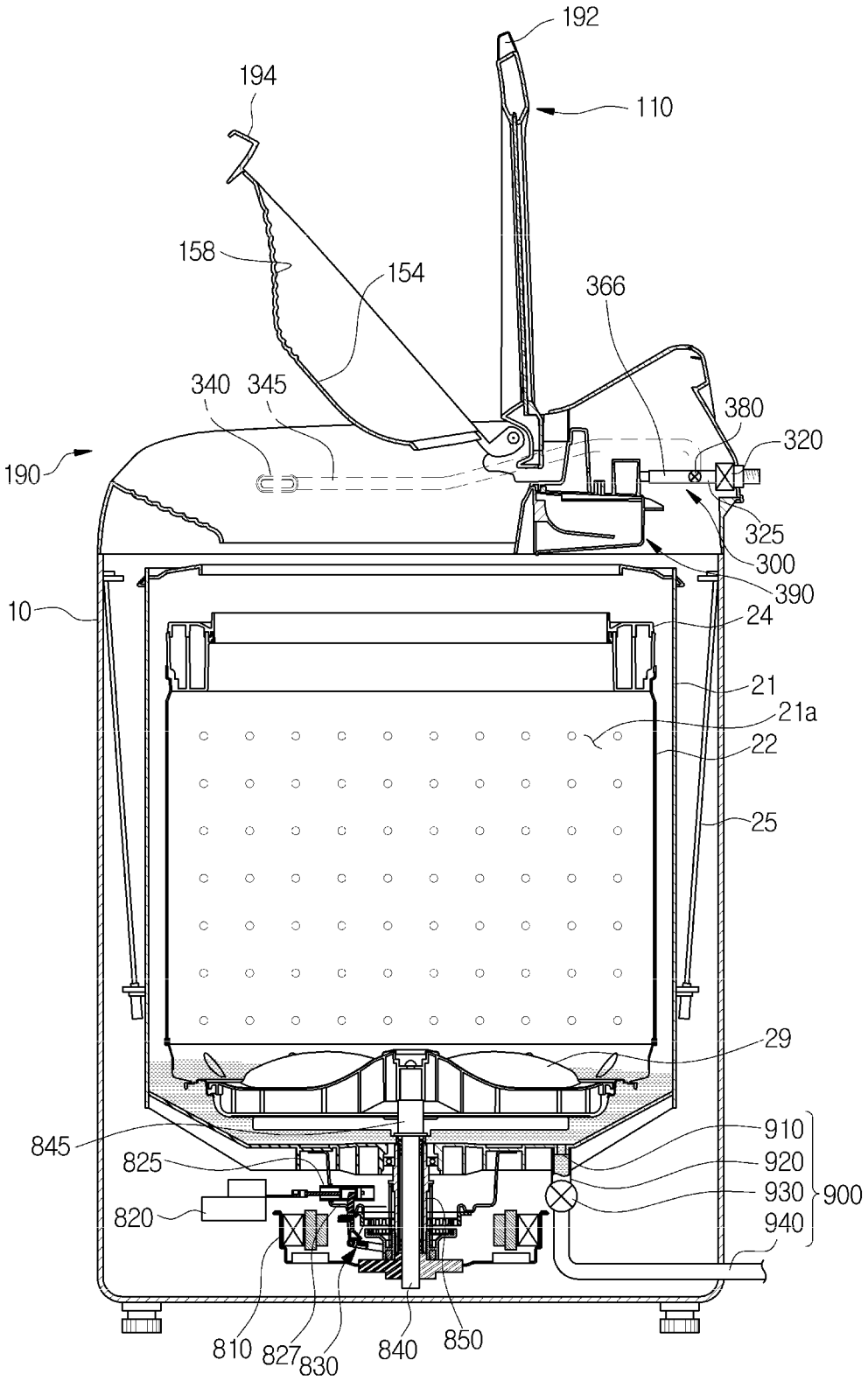

FIG. 20 shows a washing machine with washing water supplied to the auxiliary washing unit in response to a user instruction, FIGS. 21 and 22 shows diagrams for explaining an embodiment of how washing water goes into the outer tub from the auxiliary washing unit, and FIGS. 23 and 24 are diagrams for explaining an embodiment of how washing water contained in the outer tub to be drained in response to a user instruction. Shadowed areas shown in FIGS. 20 to 24 indicate washing water.

The user may input an instruction to supply water for auxiliary washing. Once the auxiliary washing is initiated by the user instruction, washing water may be supplied from the auxiliary water supply outlet 340 to the auxiliary washing unit 150, as shown in FIG. 20. Since the auxiliary washing unit 150 forms the auxiliary washing space 150*a* for washing by hand, washing by hand may be performed in the space using the supplied washing water.

The washing water used in the washing by hand may be discharged to the outer tub 21 through the auxiliary drain 960 of the auxiliary washing unit 150. Since the auxiliary washing unit 150 is able to pivot about one side, when it pivots as in FIG. 13B, the washing water used in the washing by hand may be discharged to the outer tub 21 through the auxiliary drain 960.

When the user initially presses the start button 530 to start auxiliary washing, washing water is supplied to the auxiliary washing unit 150 and drainage by the drainage unit 900 is simultaneously blocked. At the same time, as shown in FIG.

21, the washing water reuse indicator LED 612 is turned on, which indicates that drainage by the drainage unit 900 is not in progress.

As a result, as shown in FIG. 22, the washing water discharged to the outer tub 21 may not be drained but remains in the outer tub 21. The user may determine whether to drain the washing water in consideration of the contamination degree of the washing water, and decide whether to input the instruction for drainage to drain the washing water.

When the user determines that the washing water is available for main washing, the user may proceed with washing by selecting a desired washing method or cycle without draining the washing water. In this regard, since drainage by the drainage unit 900 is currently blocked, the user does not need to input an additional instruction to block drainage.

However, when it is determined not to reuse the washing water used in the auxiliary washing for main washing, the user may input the instruction for drainage. For this, as shown in the upper diagram of FIG. 23, the user may press the drain input button 510.

In response to the user input, the display unit 600 may turn on the drainage selection indicator LED 611 to indicate that the instruction for drainage has been input.

Next, as shown in the lower diagram of FIG. 23, the user may press the start button 530 to drain the washing water. As a result, the drainage valve 930 is open, and as shown in FIG. 24, the washing water may be drained by the drainage unit 900.

While the washing water is being drained, the display unit 600 may inform that drainage is in progress. For example, while drainage is in progress, the drainage selection indicator LED 611 may be repeatedly turned on for a predetermined time. As a result, the drainage selection indicator LED 611 may be turned on and off at predetermined intervals, and thus the user may visually recognize that washing water is being drained.

Alternatively, while washing water is being drained, the display unit 600 including the display panel 620 may display text on the display panel 620 indicating that drainage is underway.

Figure 25:
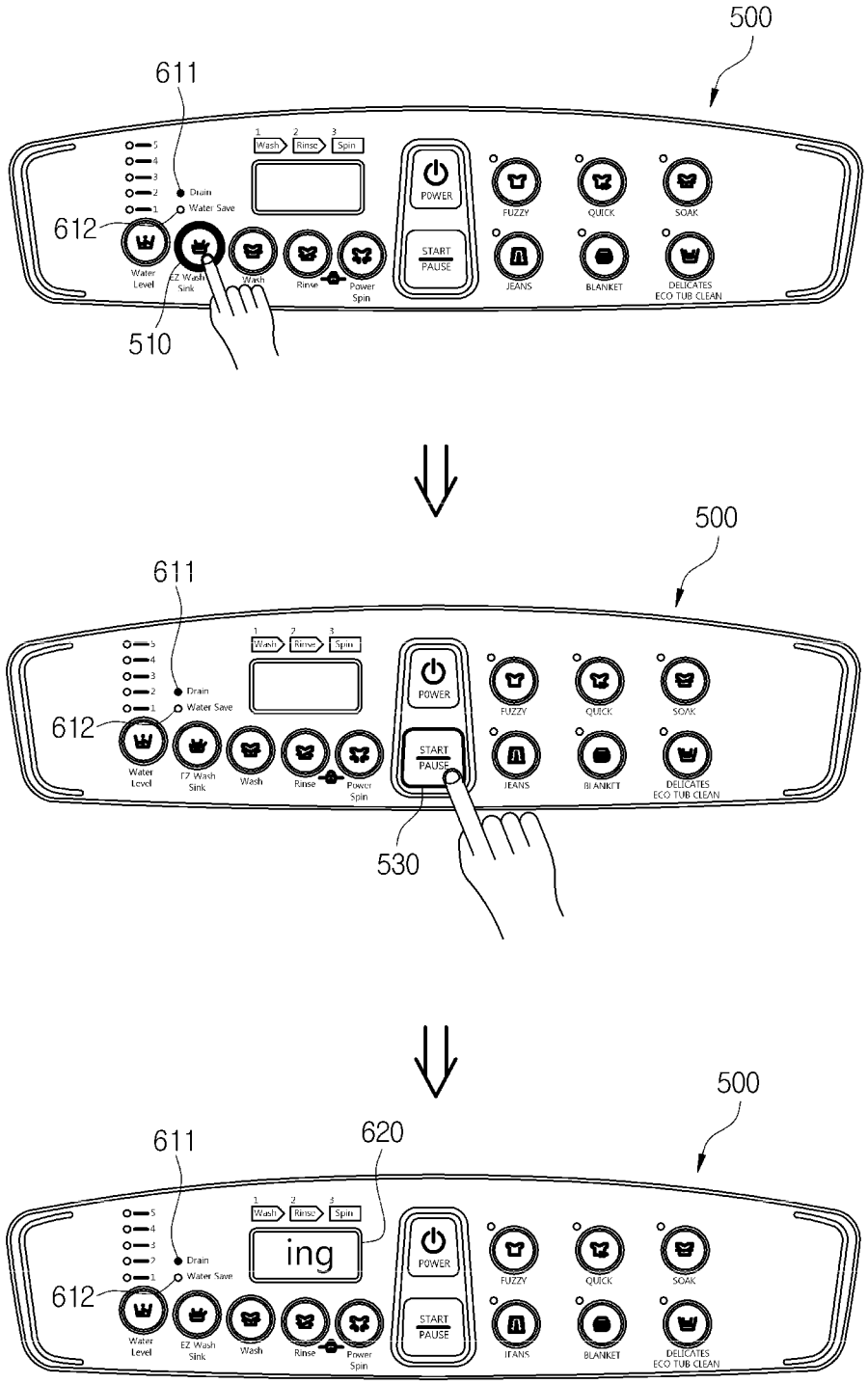
FIGS. 25 and 26 are diagrams for explaining how an display unit informs that washing water is being drained according to an embodiment of the disclosure.
Figure 26:
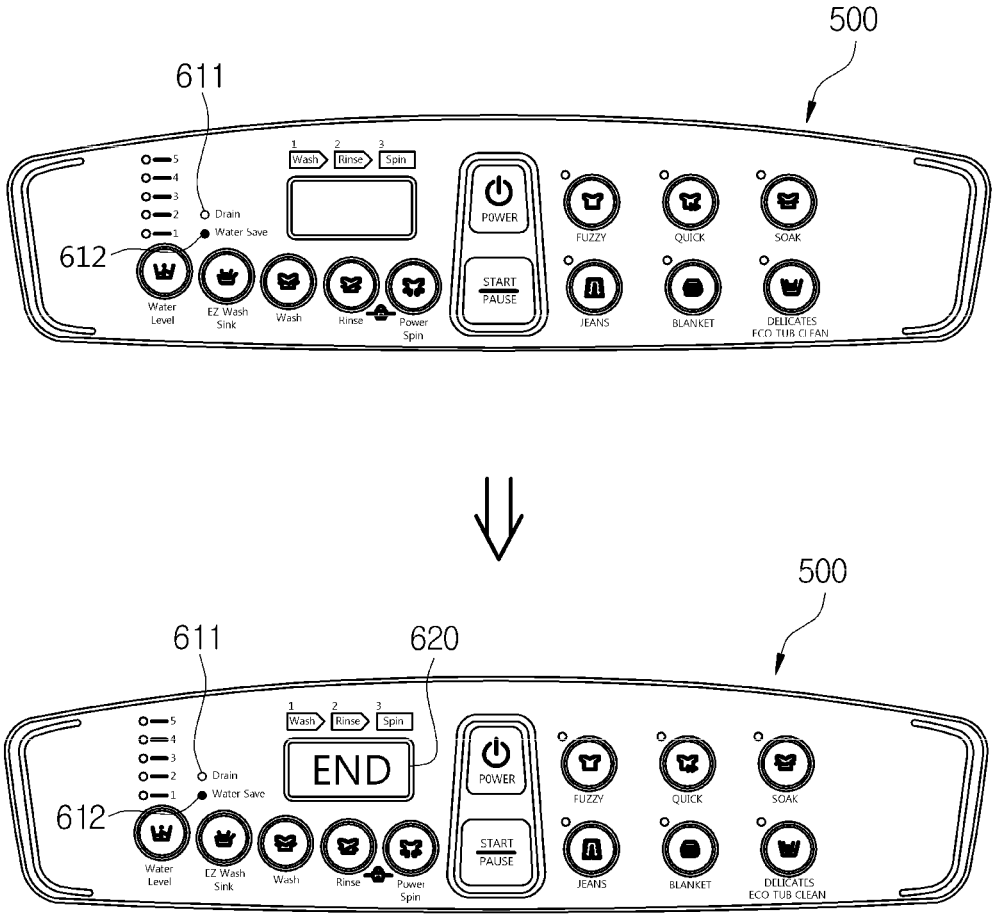

FIGS. 25 and 26 are diagrams for explaining an embodiment of a method for informing that washing water is being drained.

When the user inputs the instruction for drainage as shown in the upper diagram of FIG. 25 and the user presses the start button 530 as shown in the middle diagram of FIG. 25, washing water starts to be drained. At this time, predetermined text indicating that drainage is in progress may be displayed on the display panel 620. For example, as shown in the lower diagram of FIG. 25, text such as 'ing' may be displayed on the display panel 620.

Once the drainage is completed, the drainage selection indicator LED 611 may be turned off and the washing water reuse indicator LED 612 may be turned on, as shown in the upper diagram of FIG. 26. Predetermined text indicating that drainage is completed may also be displayed on the display panel 620. For example, as shown in the lower diagram of FIG. 26, text such as 'End' may be displayed on the display panel 620.

Furthermore, while the washing water is being drained, the input unit 500 may be deactivated not to receive any instruction. When an instruction for another cycle were received while the washing water was being drained, different cycles would be performed, which may hinder normal drainage of washing water. Therefore, while washing water is being drained, the input unit 500 may be deactivated to prevent an instruction from being input even when the user presses a button in the input unit 500.

The instruction for drainage may determine not only whether to drain but also a desired water level of the washing water in the outer tub 21. With this, the washing water in the outer tub 21 may be drained until it is equal to or greater than the desired water level.

Figure 27:
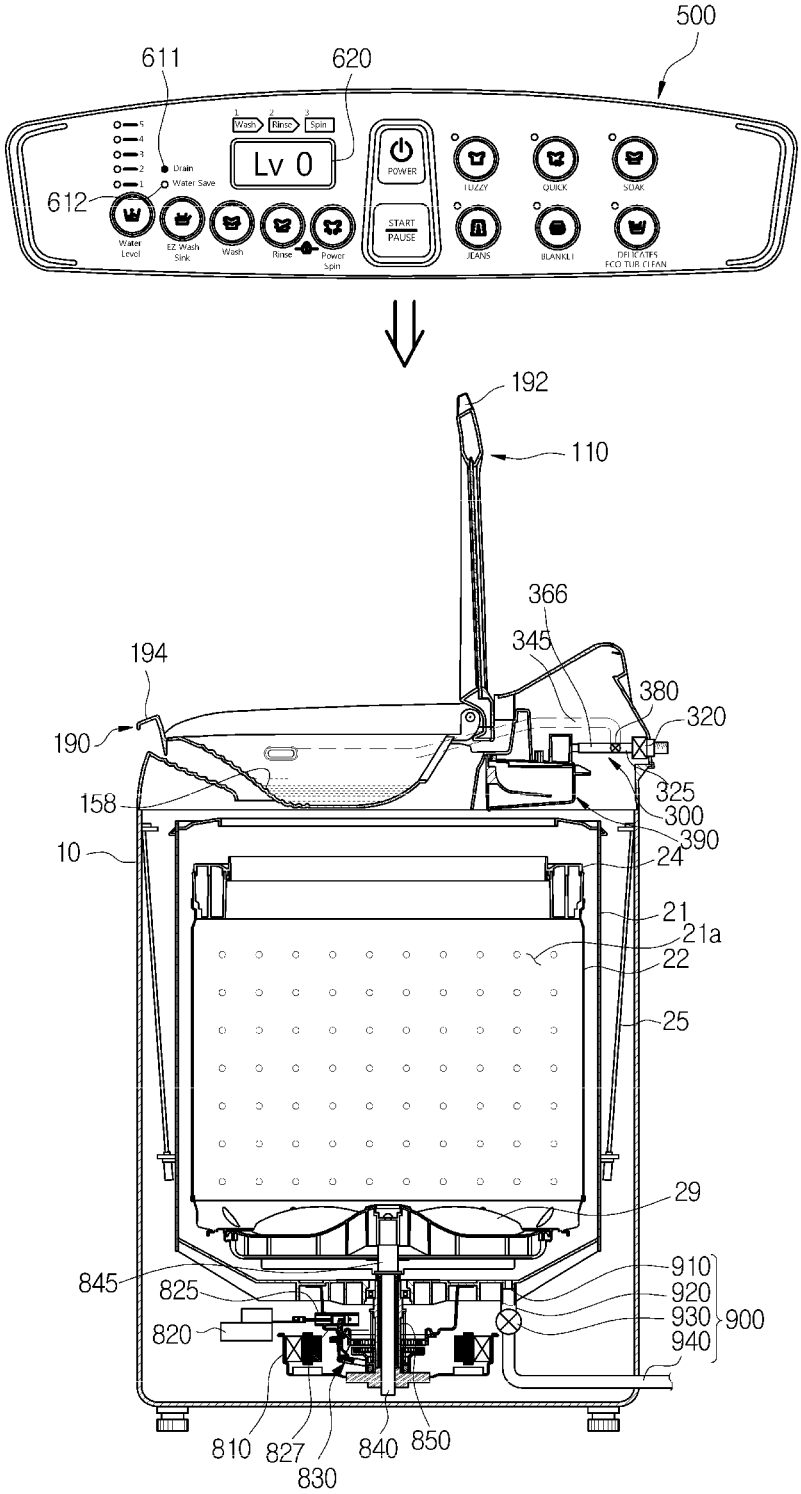
FIGS. 27, 28, and 29 are diagrams for explaining a method for draining washing water in response to an instruction for drainage including a washing water level according to an embodiment of the disclosure.
Figure 28:
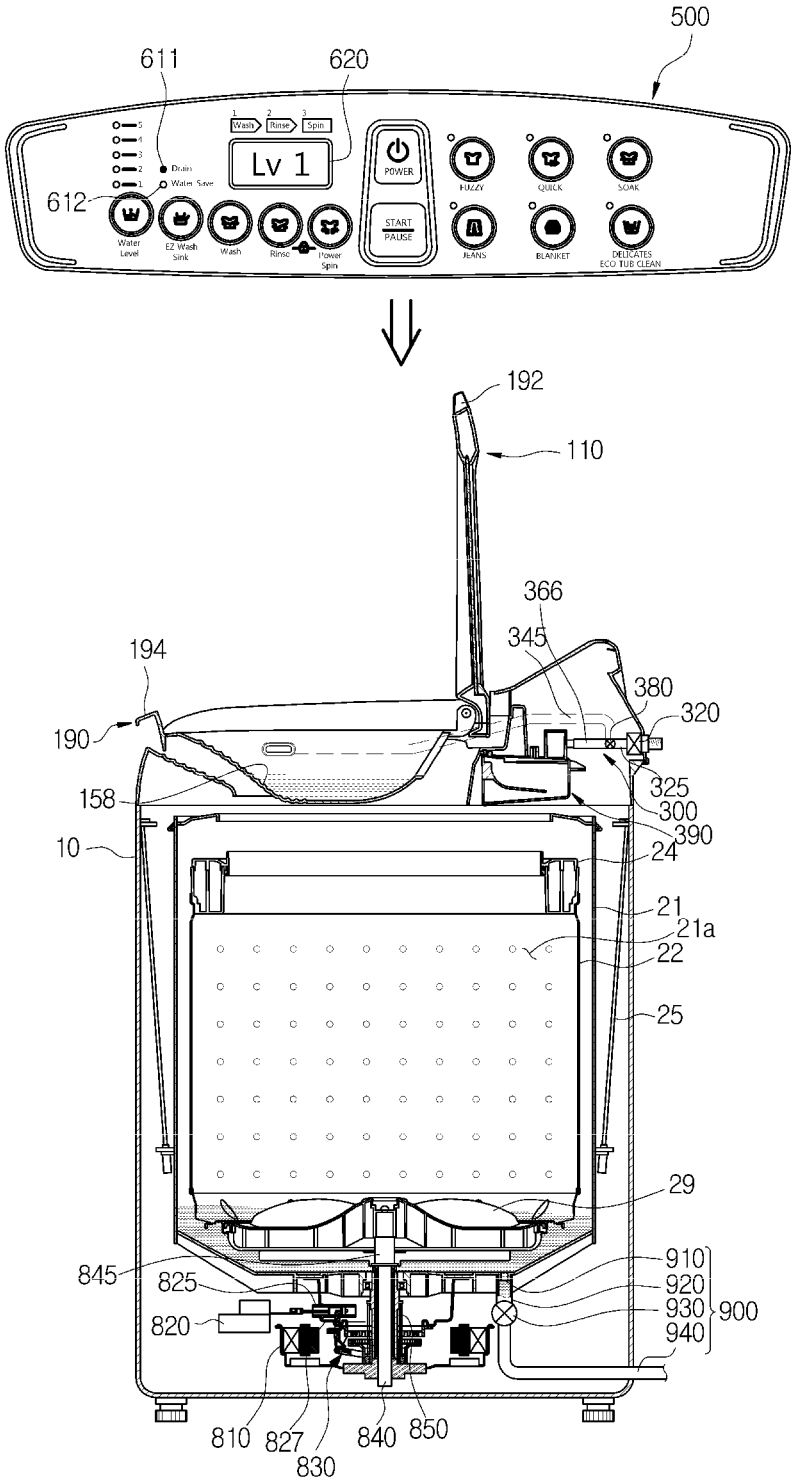
Figure 29:
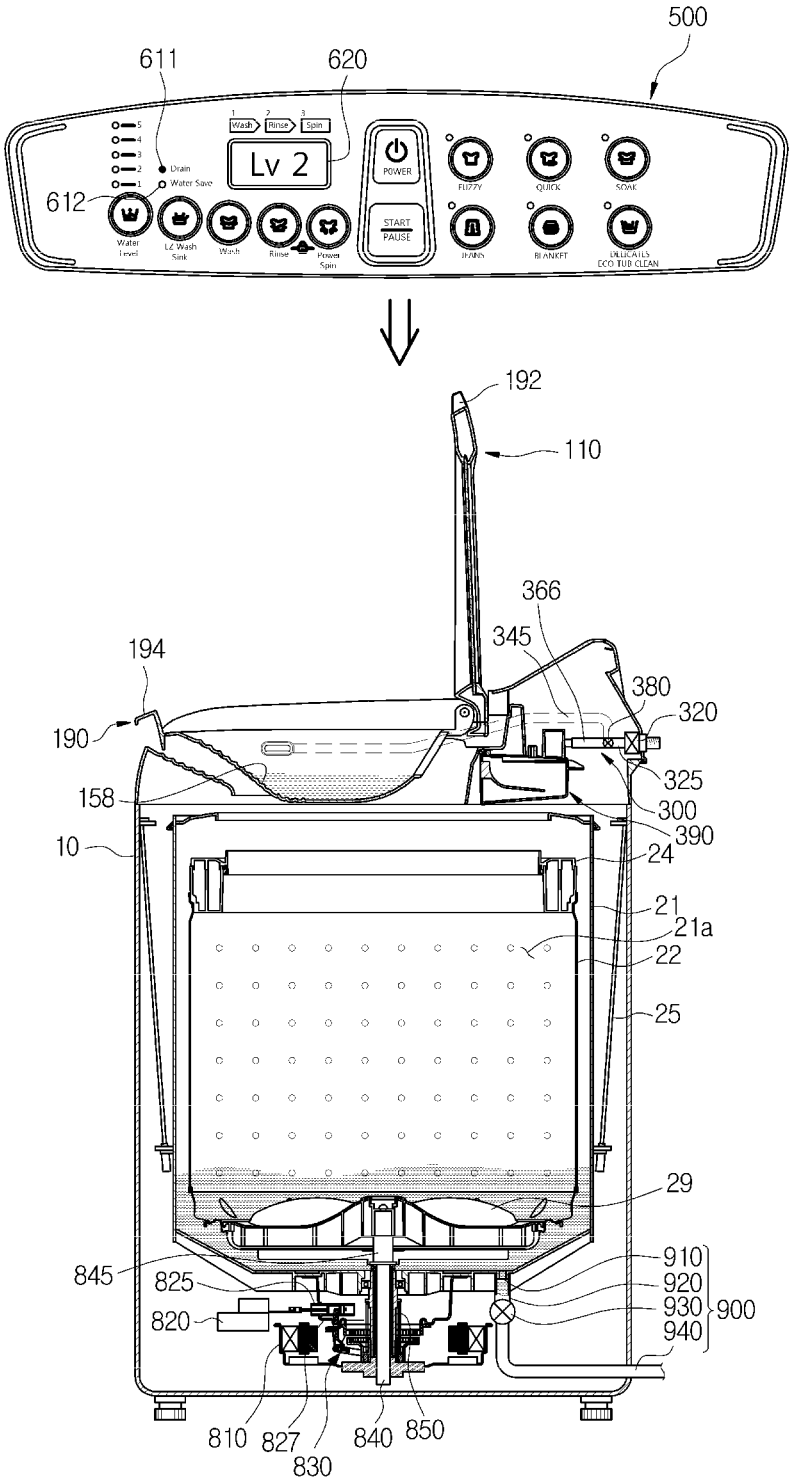

FIGS. 27 to 29 are diagrams for explaining an embodiment of a method for draining washing water in response to the instruction for drainage including a washing water level.

The upper diagram of FIG. 27 illustrates a case in which an instruction for drainage is input to leave washing water corresponding to water level 0 in the outer tub 21 and discharge the rest. In response to the instruction, the washing water contained in the outer tub 21 may be drained until it reaches water level 0. In the lower diagram of FIG. 27, the water level 0 refers to a level at which all washing water contained in the outer tub 21 is drained out.

The upper diagram of FIG. 28 illustrates a case in which an instruction for drainage is input to leave washing water corresponding to water level 1 in the outer tub 21 and discharge the rest. In response to the instruction, the washing water contained in the outer tub 21 may be drained until it reaches water level 1, as shown in the lower diagram of FIG. 28.

Furthermore, as shown in FIG. 29, the washing water contained in the outer tub 21 may be drained until it reaches water level 2.

Referring to FIGS. 27 to 29, it may be seen that when the instructed water level is higher, the water level of washing water left in the outer tub 21 is higher. However, the above embodiments are only exemplary, and in some embodiments, when the instructed water level is lower, the water level of washing water left in the outer tub 21 may be higher.

The instructed water level may be determined according to a time for which the drain input button 510 is pressed and held. That is, when the drain input button 510 is pressed longer, the instructed washing water level may increase.

Furthermore, as shown in FIGS. 27 to 29, the water level corresponding to the time for which the drain input button 510 is pressed and held may be displayed on the display panel 620. The user may input the instruction for drainage including a desired water level by controlling the time for which the drain input button 510 is pressed and held while checking the display panel 620.

The water level sensing unit 210 may measure the washing water level inside the outer tub 21. Even without receiving the instruction for drainage through the input unit 500, the control unit 400 may control the drainage unit 900 to drain the washing water only when a measured water level is equal to or greater than a predetermined level.

The turbidity sensing unit 250 may measure washing water turbidity inside the outer tub 21. Even without receiving the instruction for drainage through the input unit 500, the control unit 400 may control the drainage unit 900 to drain the washing water only when a measured turbidity level is equal to or greater than a predetermined level.

In this way, even when the user has never determined whether the washing water used in auxiliary washing is reusable and never input the instruction for drainage, the washing water may be automatically drained when the washing water level or the turbidity level is so high that main washing is difficult with the washing water.

Figure 30:
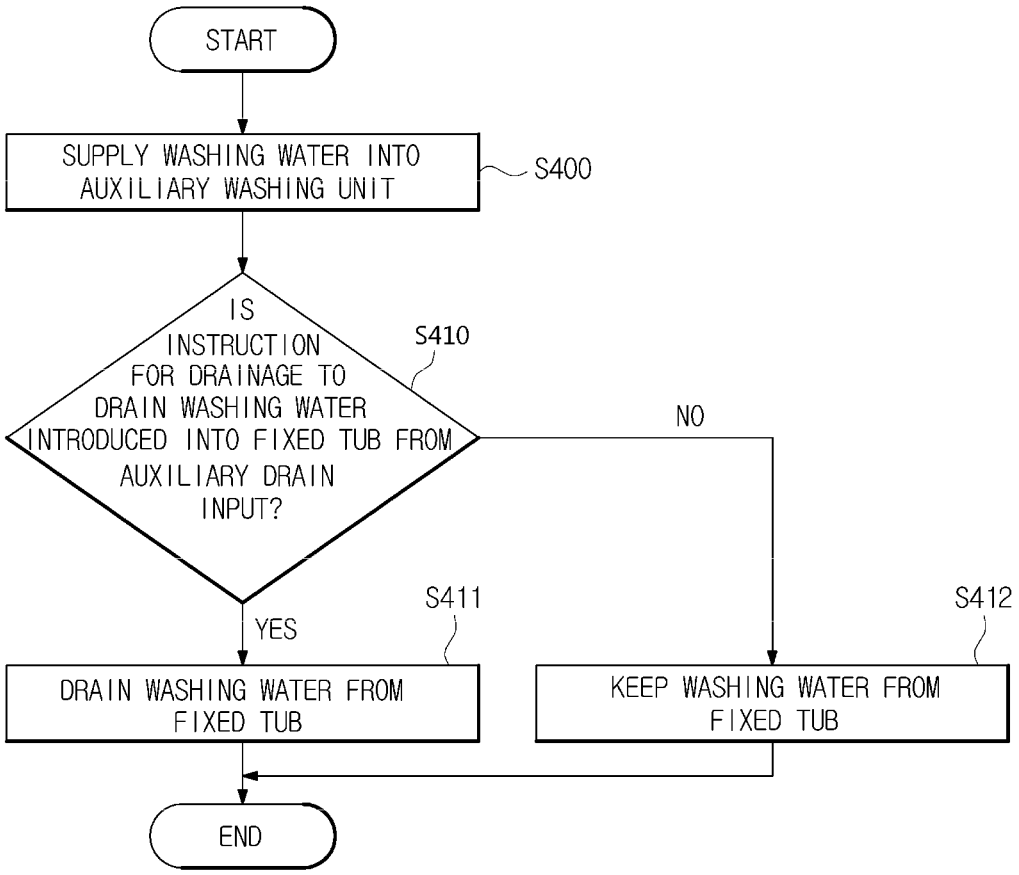
FIG. 30 is a flowchart illustrating a method for draining washing water according to an embodiment of the disclosure.

FIG. 30 is a flowchart illustrating a method for draining washing water according to an embodiment of the disclosure.

First, washing water is supplied to the auxiliary washing unit in step S400. This may be performed in response to an instruction input through the input unit. Since the auxiliary washing unit defines the auxiliary washing space, the user may perform washing by hand, i.e., auxiliary washing, with washing water supplied to the space.

The auxiliary washing unit includes the auxiliary drain and may be pivotable about one side, and thus washing water used in the auxiliary washing may be discharged through the auxiliary drain by pivoting the auxiliary washing unit. The discharged washing water may go into the outer tub.

Next, it is determined whether an instruction for drainage has been received in step S410. The instruction for drainage refers to an instruction input through the input unit to drain the washing water discharged from the auxiliary washing unit into the outer tub.

In this way, the user may determine whether to reuse the washing water used in auxiliary washing by deciding whether to input the instruction for drainage. When the user wants to reuse the washing water used in auxiliary washing, the user may not input the instruction for drainage, and when the user does not want to reuse the washing water used in auxiliary washing, the user may input the instruction for drainage.

When the instruction for drainage is input, the washing water discharged into the outer tub through the auxiliary drain may be drained away in step S411. Otherwise, when the instruction for drainage is not input, the washing water discharged into the outer tub through the auxiliary drain may not be drained but remain in the outer tub to be reused for main washing in step S412.

Figure 31:
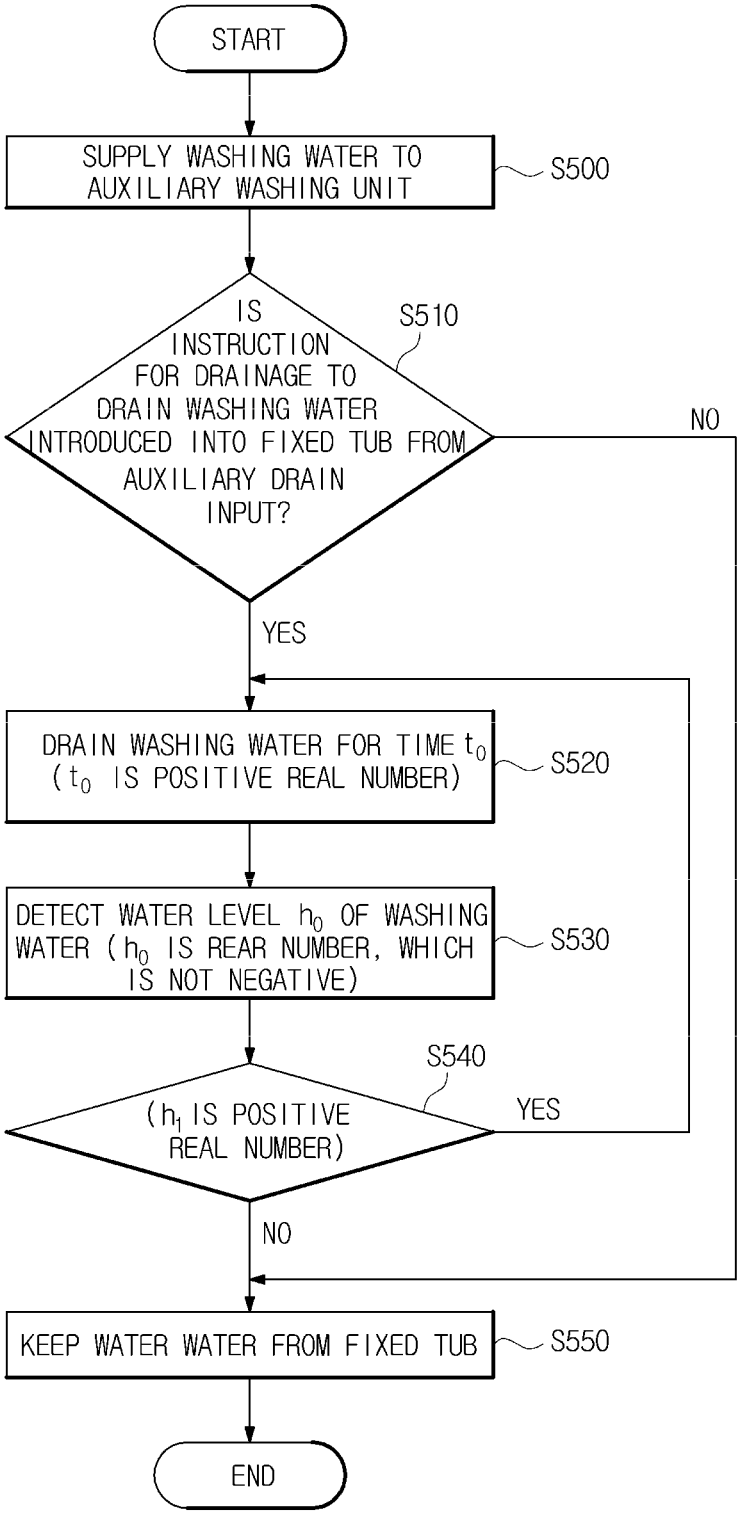
FIG. 31 is a flowchart illustrating a method for draining washing water according to another embodiment of the disclosure.

FIG. 31 is a flowchart illustrating a method for draining washing water according to another embodiment of the disclosure.

First, as in FIG. 30, washing water is supplied to the auxiliary washing unit in step S500. The supplied washing water may travel into the outer tub due to pivotal movement of the auxiliary washing unit.

Next, it is determined whether an instruction for drainage has been received in step S510. The instruction for drainage may be the same as the instruction for drainage of FIG. 30.

Once the instruction for drainage is received, the washing water contained in the outer tub may be drained for a predetermined time period t0 in step S520. The predetermined time period to is a time period required to drain the washing water discharged into the outer tub from the auxiliary drain of the auxiliary washing unit until a water level of the washing water stored in the outer tub becomes lower than a threshold water level.

The time period t0 may be determined based on a user input or by internal calculation of the device. Alternatively, the time period t0 may be determined in the manufacturing stage.

After the washing water is drained from the outer tub for the predetermined time period t0, a water level h0 of washing water left in the outer tub is measured in step S530. To measure the water level h0 of the washing water, a height from a predetermined reference point inside the outer tub may be measured.

It is determined whether the water level h0 of the washing water left in the outer tub is equal to or greater than a predetermined level h1 in step S540. The predetermined level h1 is a threshold water level in the outer tub, which is a limit of the water level of washing water left in the outer tub after draining.

Accordingly, when the water level h0 of the washing water left in the outer tub is equal to or greater than the predetermined level h1, draining of the washing water in the outer tub is resumed again for the predetermined time period W. This is to keep the water level of the washing water contained in the outer tub under the predetermined level h1.

On the other hand, when the water level h0 of the washing water contained in the outer tub is lower than the predetermined level h1, the washing water contained in the outer tub is maintained without being drained in step S550.

Meanwhile, when the instruction for drainage has not been received, it means that the user intends to reuse the washing water discharged into the outer tub from the auxiliary washing unit, and thus the washing water stored in the outer tub remains the same without being drained in step S550.

Figure 32:
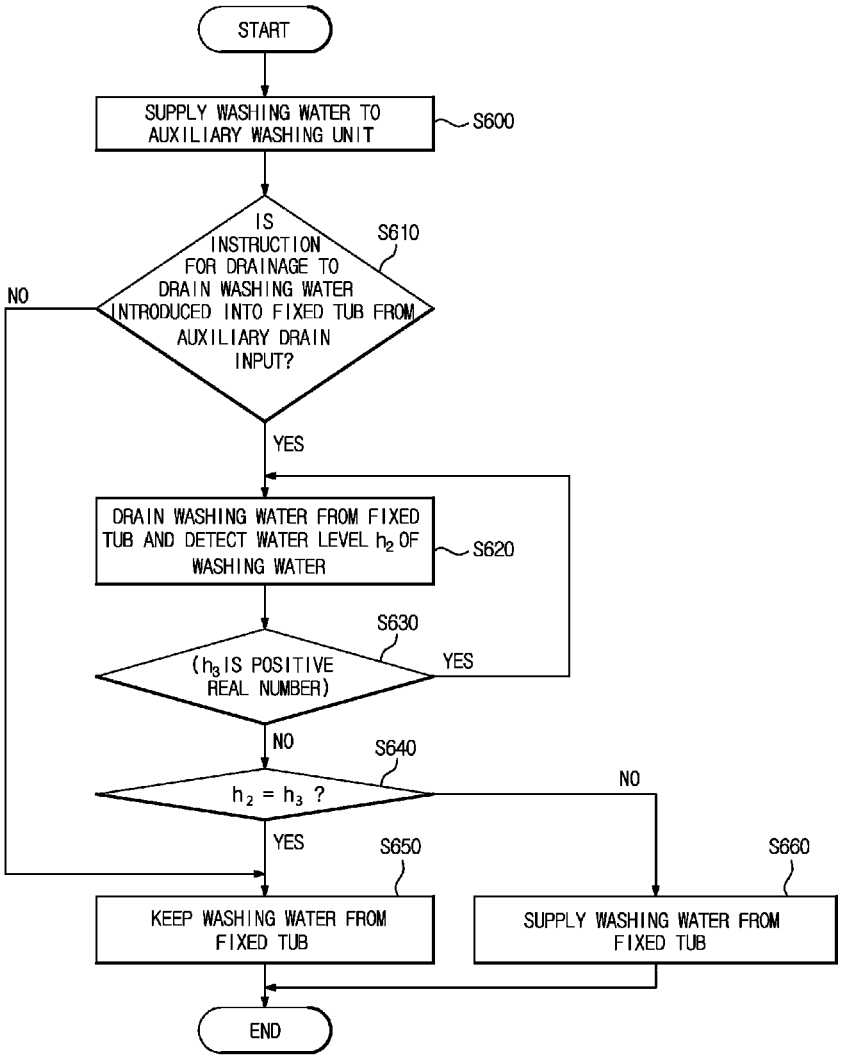
FIG. 32 is a flowchart illustrating a method for draining washing water according to another embodiment of the disclosure.

FIG. 32 is a flowchart illustrating a method for draining washing water according to another embodiment of the disclosure.

First, as in FIGS. 30 and 31, washing water is supplied to the auxiliary washing unit in step S600. The washing water supplied may travel into the outer tub due to pivotal movement of the auxiliary washing unit.

Next, it is determined if an instruction for drainage has been received in step S610. The instruction for drainage may be the same as the instruction for drainage of FIGS. 30 and 31.

However, in this embodiment of FIG. 32, the instruction for drainage includes a desired water level. The desired water level corresponds to a water level to which the washing water is desired to remain in the outer tub after being drained. As the desired water level increases, the water level of the washing water left in the outer tub may increase. Alternatively, as the desired water level decreases, the water level of the washing water left in the outer tub may increase.

Once the instruction for drainage is received, the washing water begins to be drained. While the washing water is being drained, a water level h2 of washing water left in the outer tub is measured in step S620.

The measured water level h2 is compared with a desired water level h3 in step S630. When the measured water level h2 is higher than the desired water level h3, the washing water is drained until the measured water level h2 is equal to the desired water level h3.

When the measured water level h2 is equal to the desired water level h3 in step S640, the washing water contained in the outer tub is kept the same in step S650.

Otherwise, when the measured water level h2 is lower than the desired water level h3, water may be supplied to the outer tub until the measured water level h2 is equal to the desired water level h3 in step S660.

In the above description, it has been assumed that that the washing machine includes an auxiliary washing unit, but the washing machine is not limited thereto in embodiments of the disclosure. For example, the washing machine may be modified in various forms within the technical ideas of washing machines for draining washing water contained in the outer tub in response to an instruction.

While various embodiments of the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A washing machine comprising:

a main body having a first washing space therein to hold laundry to be machine washed by the washing machine, and an opening through which the laundry to be machine washed is received into the first washing space;

a door having an opened position and a closed position to open and close, respectively, the opening;

a door position sensing unit configured to sense a position of the door;

an auxiliary washing unit having a second washing space separated from the first washing space;

a water supply unit including a water supply outlet positioned lower than the door, the water supply unit configured to supply water into the second washing, space through the water supply outlet; and a control unit configured to control the water supply unit to supply the water into the second washing space through the water supply outlet in accordance with the door position sensing unit sensing that the door is in the opened position, wherein the second washing space is configured to contain the water supplied into the second washing space and to hold laundry to be hand washed with the water contained in the second washing space.

2. The washing machine according to claim 1, further comprising:

an input unit that is operated to indicate that water supply is to be started;

wherein the control unit controls the water supply unit to start supplying the water when the input unit is operated to indicate that water supply is to be started and the door sensing unit senses that the door is in the opened position.

3. The washing machine according to claim 2, wherein the control unit controls the water supply unit to start supplying the water and to perform the supplying of the water for a predetermined time when the input unit is operated to indicate that water supply is to be started and the door sensing unit senses that the door is in the opened position.

4. The washing machine according to claim 1, further comprising:

an input unit that is operated to indicate that water supply is to be ended, wherein the control unit controls the water supply unit to stop supplying the water when the input unit is operated to indicate that water supply is to be ended while the water supply unit is supplying the water.

5. The washing machine according to claim 1, wherein:

the control unit controls the water supply unit to stop supplying the water when the door position sensing unit senses that the door is in the closed position while the water supply unit is supplying the water.

6. The washing machine according to claim 1, further comprising:

a tub having the first washing space therein and configured to contain water discharged from the auxiliary washing unit; and a water level sensing unit configured to measure a water level in the tub, wherein the control unit controls the water supply unit to stop supplying the water when the measured water level is equal to or greater than a predetermined water level while the water supply unit is supplying the water.

7. The washing machine according to claim 1, further comprising:

a distance sensing unit configured to measure a distance between a user and the main body, wherein the control unit controls the water supply unit to stop supplying the water when the measured distance is equal to or greater than a predetermined distance while the water supply unit is supplying the water.

8. The washing machine according to claim 1, wherein the control unit controls the water supply unit to stop supplying the water when a predetermined time elapses after the water supply unit starts supplying the water.

9. The washing machine according to claim 1, wherein the water supply unit includes a water temperature control unit configured to heat the supplied water, and the control unit controls the water temperature control unit to adjust a temperature of the supplied water.

10. The washing machine according to claim 1, wherein the auxiliary washing unit is positionable over the opening, when the auxiliary washing unit is positioned over the opening, the second washing space is thereby positioned to receive the water supplied into the second washing space, and the water supply unit is configured to supply the water into the second washing space when the auxiliary washing unit is positioned over the opening and the second washing space is thereby positioned to receive the water supplied into the second washing space.

11. A washing machine comprising:

a main body;

an auxiliary washing unit seatable on the main body and having a concave washing space that, when the auxiliary washing unit is seated on the main body, faces upward to thereby allow the washing space to contain water;

an outer tub;

a rotation tub that rotates and is housed inside the outer tub, wherein the auxiliary washing unit discharges the water contained in the washing space into the rotation tub, and the outer tub is configured to contain the water discharged from the auxiliary washing unit;

a drainage unit configured to drain the water contained in the outer tub;

an input unit that is operable to selectively indicate that water is to be drained or that water is to be reused; and a control unit configured to control the drainage unit to perform drainage of the water contained in the outer tub when the input unit is operated to indicate that water is to be drained and to control the drainage unit to block drainage of the water contained in the outer tub when the input unit is operated to indicate that water is to be reused.

12. The washing machine according to claim 11, wherein the control unit controls the drainage unit to entirely drain the water contained in the outer tub when the input unit is operated to indicate that water is to be drained.

13. The washing machine according to claim 11, wherein the control unit controls the drainage unit to stop drainage of the water contained in the outer tub when the input unit is operated to indicate that water is to be reused while the drainage unit performs drainage.

14. The washing machine according to claim 11, wherein a water level at which water is to be contained in the outer tub is selectable when the input unit is operated to indicate that water is to be reused.

15. The washing machine according to claim 11, further comprising:

a turbidity sensing unit configured to measure turbidity of the water contained in the outer tub or in water in the rotation tub, wherein the control unit controls the drainage unit to perform drainage of the water contained in the outer tub when the measured turbidity is equal to or greater than a predetermined value.

16. The washing machine according to claim 11, further comprising:

a display unit configured to display an indicator indicating reuse of water, wherein the control unit controls the display unit to display the indicator indicating reuse of the water when drainage by the drainage unit is terminated.

17. The washing machine according to claim 11, further comprising:

a water supply unit configured to supply water into the auxiliary washing unit, wherein the control unit configured to control the water supply unit.

18. The washing machine according to claim 17, further comprising:

an input unit which is operable to indicate that water supply is to be started, wherein the control unit controls the water supply unit to start supplying water when the input unit is operated to indicate that water supply is to be started.

* * * * *